US011795722B1

(12) United States Patent
Hagemeister

(10) Patent No.: US 11,795,722 B1
(45) Date of Patent: Oct. 24, 2023

(54) TORNADO SHELTER

(71) Applicant: Robert Hagemeister, Westbrook, CT (US)

(72) Inventor: Robert Hagemeister, Westbrook, CT (US)

( * ) Notice: Subject to any disclaimer, the term of this patent is extended or adjusted under 35 U.S.C. 154(b) by 11 days.

(21) Appl. No.: 17/229,466

(22) Filed: Apr. 13, 2021

Related U.S. Application Data

(60) Provisional application No. 63/009,317, filed on Apr. 13, 2020.

(51) Int. Cl.
*E04H 9/14* (2006.01)
*E04B 1/16* (2006.01)

(52) U.S. Cl.
CPC ..... *E04H 9/14* (2013.01); *E04B 1/166* (2013.01)

(58) Field of Classification Search
None
See application file for complete search history.

(56) References Cited

U.S. PATENT DOCUMENTS 1,778,889 A * 10/1930 Disbro ..... E04C 2/08 52/584.1
3,974,599 A * 8/1976 Grosh ..... E02D 29/12 52/169.6
4,226,062 A * 10/1980 Doane ..... E04B 1/0015 52/107
4,425,929 A * 1/1984 Von Mosshaim ..... E04H 15/38 52/63
4,660,334 A * 4/1987 McCarthy ..... E04H 9/12 285/224
4,953,734 A * 9/1990 Stohr ..... F16M 1/00 52/762
4,955,166 A * 9/1990 Qualline ..... E04H 9/12 D25/36
6,085,475 A * 7/2000 Parks ..... E04H 9/14 52/79.14
6,131,343 A * 10/2000 Jackson, Jr. ..... E04H 9/14 52/745.07
6,161,345 A * 12/2000 Hope ..... E04H 9/06 49/228
6,343,443 B1 * 2/2002 Tylicki, Jr. ..... E04B 1/34336 52/432
6,385,919 B1 * 5/2002 McCarthy ..... E04H 9/12 109/1 S (Continued)

FOREIGN PATENT DOCUMENTS

WO WO-2019167211 A1 * 9/2019

OTHER PUBLICATIONS

"Tornado climatology", https://en.wikipedia.org/wiki/Tornado_climatology, accessed Jul. 13, 2021, 13 pgs.

(Continued)

*Primary Examiner* — Joshua K Ihezie
(74) *Attorney, Agent, or Firm* — HAYES SOLOWAY P.C.

(57) ABSTRACT

A tornado shelter apparatus includes a substantially unitary shell positionable at least partially below a ground surface. A cover is slidably movable over an opening of the shell. The cover has an arced shape with a substantial center point of the cover being positioned higher than a side edge of the cover. At least one lock is provided for removably locking the cover to the shell.

13 Claims, 18 Drawing Sheets

(56) References Cited

U.S. PATENT DOCUMENTS

| | | | | |
|---|---|---|---|---|
| 6,434,896 | B1 * | 8/2002 | Mitchell | E04H 9/14 52/80.2 |
| 7,428,800 | B1 * | 9/2008 | Vaughn | E04H 9/12 52/169.9 |
| 8,176,692 | B2 * | 5/2012 | Crow | E04H 9/14 52/169.6 |
| 8,646,225 | B2 * | 2/2014 | Wirtz | E04H 6/00 52/169.6 |
| 8,661,746 | B1 * | 3/2014 | Kouba | E02D 27/00 109/1 S |
| 8,756,869 | B1 * | 6/2014 | Routt | E05C 1/10 49/33 |
| 8,925,261 | B1 * | 1/2015 | Kouba | E02D 27/00 109/1 S |
| 2003/0167708 | A1 * | 9/2003 | Shaw | E04H 9/14 52/169.6 |
| 2007/0251159 | A1 * | 11/2007 | Wagner | E04H 9/145 52/19 |
| 2008/0172954 | A1 * | 7/2008 | Cravens | E04H 9/12 52/169.6 |
| 2011/0088339 | A1 * | 4/2011 | McCarthy | E04H 9/12 52/169.6 |
| 2012/0079780 | A1 * | 4/2012 | Wirtz | E04H 6/00 52/173.1 |
| 2013/0125478 | A1 * | 5/2013 | Trochan | E04H 9/14 52/80.1 |
| 2015/0275502 | A1 * | 10/2015 | Guo | E04H 9/14 52/741.1 |

OTHER PUBLICATIONS 4 in. x 50 ft. Expansion Joint for Concrete by Reflectix. https://www.homedepot.com/p/Reflectx-4-in-x-50-ft-Expansion-Joint-for-Concrete-EXP04050/203151902, accessed Jul. 13, 2021, 3 pgs.

Barrie, "This foam stops bullets cold and pulverizes them to dust", Fox News, https://www.foxnews.com/tech/this-foam-stops-bullets-cold-and-pulverizes-them-to-dust, Feb. 23, 2017, 8 pgs.

Marine Grade Stainless Steel Heavy Duty Door Hasp with Turning Padlock Eye Mount, by Marine Part Depot, https://www.amazon.com/Stainless-Steel-Turning-Padlock-Mount/dp/B01DHBWOAU/ref=sr_1_31_sspa?keywords=locks&qid=1555367938&rnid=2941120011&s=hi&sr=1-31-spons&psc=1, accessed Jul. 13, 2021, 8 pgs.

Tornado Shelters, by Tornado Safe, http://www.tornadosafe.com/tomado-shelters/, accessed Jul. 13, 2021, 9 pgs.

Tornado Safe Underground Infinity Shelter—Small—8 People, by EarthTech Products, https://www.earthtechproducts.com/tornadosafe-underground-garage-unit-Small.html?utm_source=googleshopping&utm_medium=cse&utm_campaign=broi&gdffi=5c42408c468c4d57be3f9140e1306624&gdfms=80026F3B14B84B6B832964F1855743B9&gclid-CjOKCQjwoKzsBRC5ARIsAITcwXFW_gwQHt7BUwqZuKdZKLMEmnWn6cc8B8Qbjvy2BpX-tKh43DzuxXQaApmjEALw_wcB , accessed Jul. 13, 2021, 14 pgs.

* cited by examiner

TORNADO SHELTER

CROSS REFERENCE TO RELATED APPLICATION

This application claims benefit of U.S. Provisional Application Ser. No. 63/009,317, entitled, "Tornado Shelter" and filed Apr. 13, 2020, the entire disclosure of which is incorporated herein by reference.

FIELD OF THE DISCLOSURE

The present disclosure is generally related to shelters and more particularly is related to tornado shelters.

BACKGROUND OF THE DISCLOSURE

A tornado is a weather event which can have violent effects. Tornadoes come in many shapes and sizes, but they are typically in the form of a visible condensation funnel, whose narrow end touches the earth and is often encircled by a cloud of debris and dust. The wind strength of the tornado, which generally ranges from 65 miles per hour (MPH) for an EF-0 rated tornado, to over 200 MPH for an EF-5 rated tornado, can cause significant damage to objects and individuals in the path of the tornado.

Tornado protection devices are conventionally available, and they often provide a level of physical protection from the effects of a tornado. For example, some tornado protection devices include a 'safe room' or equivalent space within a house such as in a dedicated protected area of a building, or more sometimes, buried below ground. While these conventional devices and systems are able to provide a high level of protection, they are very expensive, often costing several thousand to tens of thousands of dollars. The high cost is commonly due to the devices being manufactured from steel and concrete, such as concrete bunkers or welded steel units. Due to the weight and size, these devices generally must be manufactured locally and in smaller quantities in order to keep shipping costs reasonable, with final assembly on-site. Additionally, the costs can be high due to the fact these devices are made one at a time and take a long time to produce. As a result, this price range acts to exclude a vast majority of people who could benefit from tornado protection devices. Additionally, these devices can have design features which can be problematic for occupants after a tornado has passed through. For example, some devices use outward swinging doors which become obstructed by tornado debris, leaving the occupants trapped inside.

Thus, a heretofore unaddressed need exists in the industry to address the aforementioned deficiencies and inadequacies.

SUMMARY OF THE DISCLOSURE

Embodiments of the present disclosure provide a system, method, and apparatus for a tornado shelter apparatus. Briefly described, in architecture, one embodiment of the system, among others, can be implemented as follows. The tornado shelter apparatus has a substantially unitary shell positionable at least partially below a ground surface. A cover is slidably movable over an opening of the shell. The cover has an arced shape with a substantial center point of the cover being positioned higher than a side edge of the cover. At least one lock is provided for removably locking the cover to the shell.

The present disclosure can also be viewed as providing a system for providing a tornado shelter. Briefly described, in architecture, one embodiment of the system, among others, can be implemented as follows. A substantially unitary shell is formed from a plastic or fiberglass material, the substantially unitary shell is positionable at least partially below a ground surface, whereby an upper flange of the shell is positioned substantially flush with the ground surface, wherein the shell has an interior compartment and an opening to the interior compartment. A cover is slidably movable over the opening of the shell from a lateral direction, wherein the cover has a non-planar shape, whereby a substantial center point of the cover is positioned higher than a side edge of the cover. A track system is positioned along at least a portion of the upper flange of the shell, the track system facilitating lateral slidable movement of the cover. At least one removable locking fastener is capable of being used by an individual within the interior compartment to removably lock the cover to the shell.

The present disclosure can also be viewed as providing methods of manufacturing a tornado shelter apparatus. In this regard, one embodiment of such a method, among others, can be broadly summarized by the following steps: mold-forming a substantially unitary shell, the shell having a truncated cone shape having an angular sidewall, whereby a width dimension between opposing sidewalls at a top of the shell is greater than a width dimension between opposing sidewalls at a bottom of the shell; mold-forming a cover slidably movable over an opening of the shell, wherein the cover has an arced shape with a substantial center point of the cover being positioned higher than a side edge of the cover; transporting the shell to an installation location; positioning the shell at least partially below a ground surface; positioning a quantity of concrete external to the shell and in abutment with the shell; and modifying a ground surface around a substantial circumference of the shell until the ground surface is substantially flush with the cover, when positioned on the shell.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
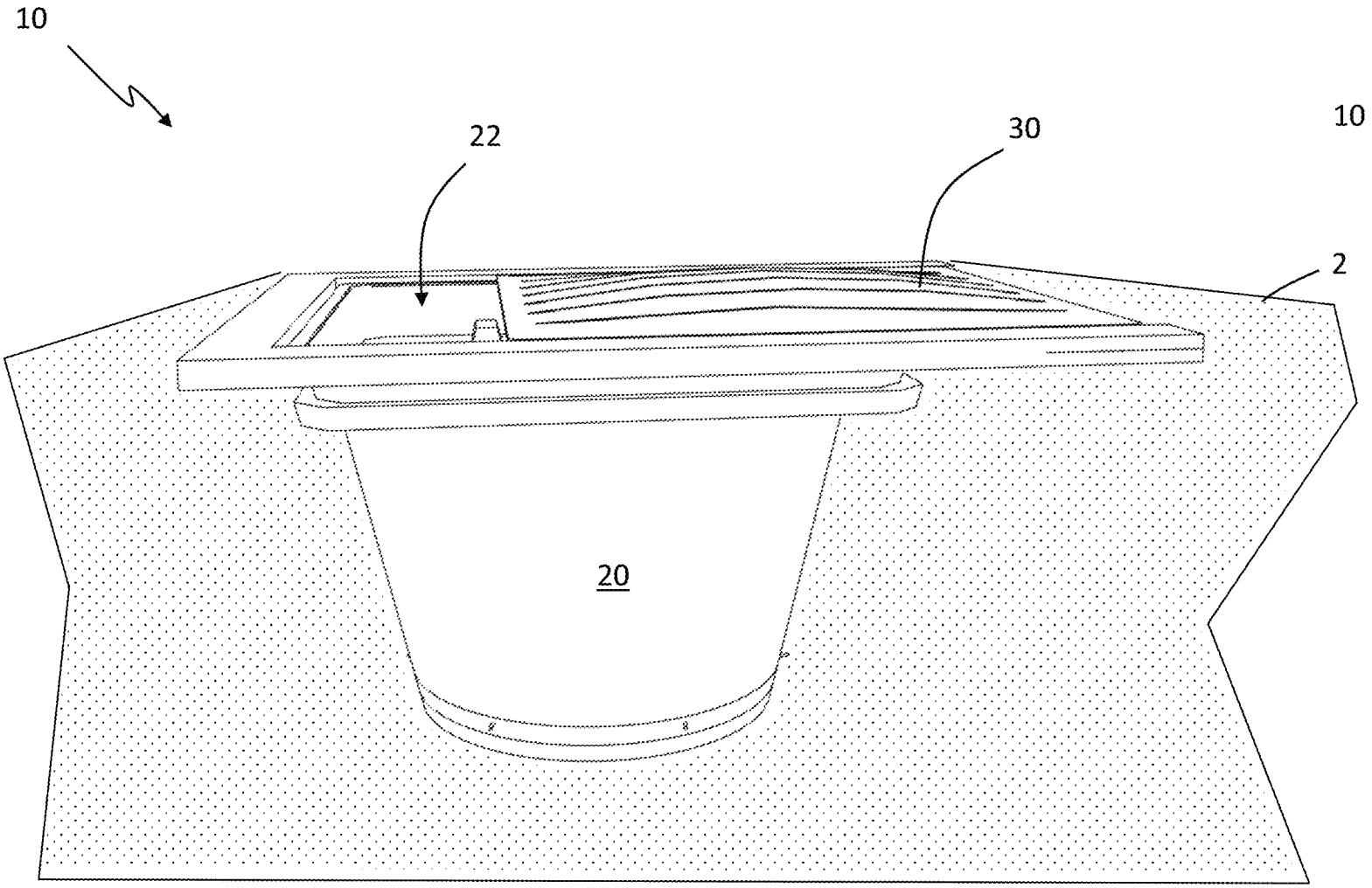
FIG. 1 is an elevated side view illustration of a tornado shelter apparatus, in accordance with a first exemplary embodiment of the present disclosure.

To overcome the aforementioned deficiencies in conventional tornado protection devices, the subject disclosed is directed to a tornado shelter apparatus 10. FIG. 1 is an elevated side view illustration of a tornado shelter apparatus 10, in accordance with a first exemplary embodiment of the present disclosure. The tornado shelter apparatus 10 has a substantially unitary shell 20 which is positionable at least partially below a ground surface 2. A cover 30 is slidably movable over an opening 22 of the shell 20. The cover 30 has an arced shape with a substantial center point of the cover being positioned higher than a side edge of the cover. At least one lock is positioned to removably lock the cover 30 to the shell 20, as described relative to other figures.

Figure 2A:
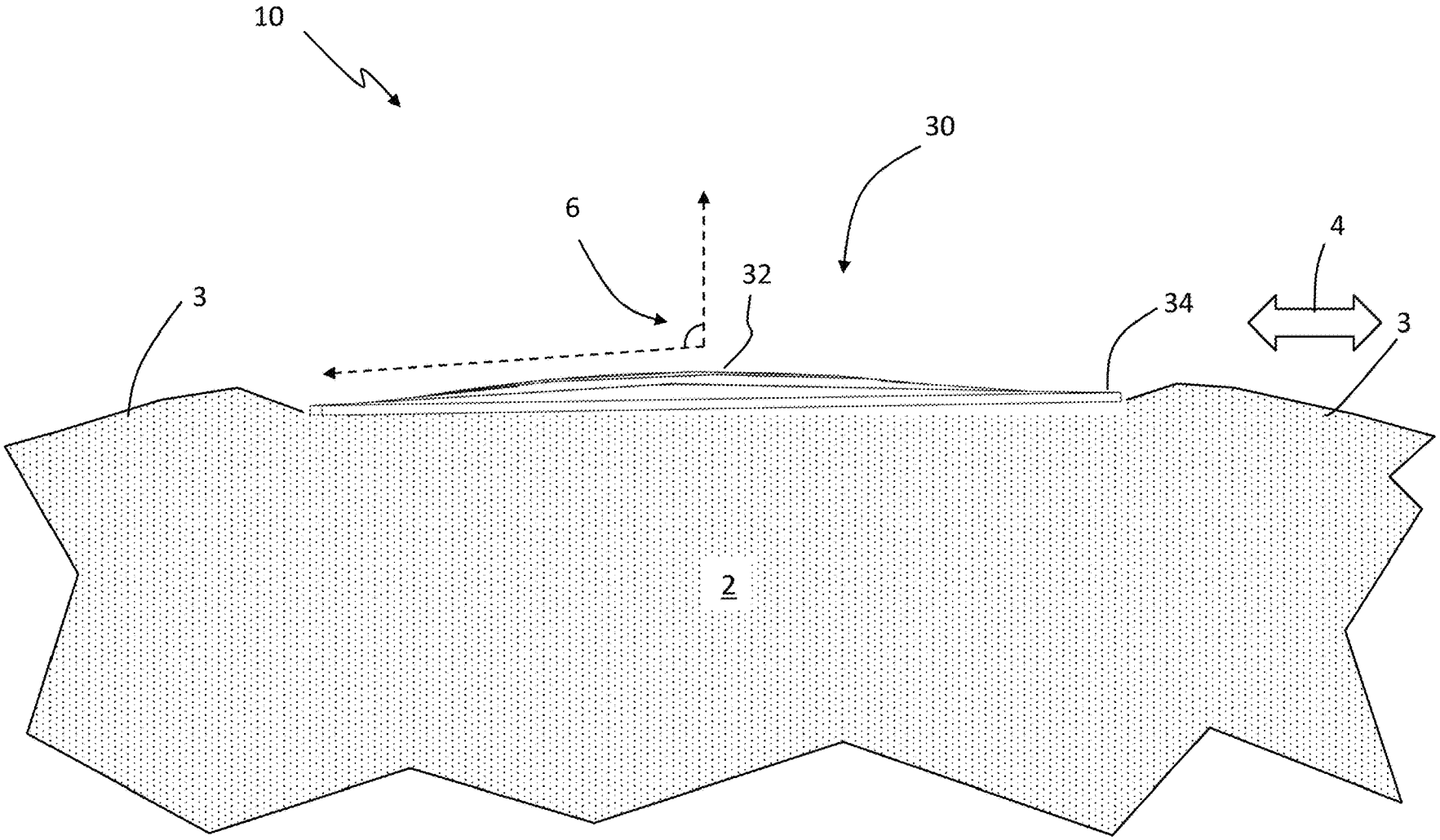
FIGS. 2A-2B are elevated side view illustrations of the tornado shelter apparatus cover, in accordance with the first exemplary embodiment of the present disclosure.
Figure 2B:
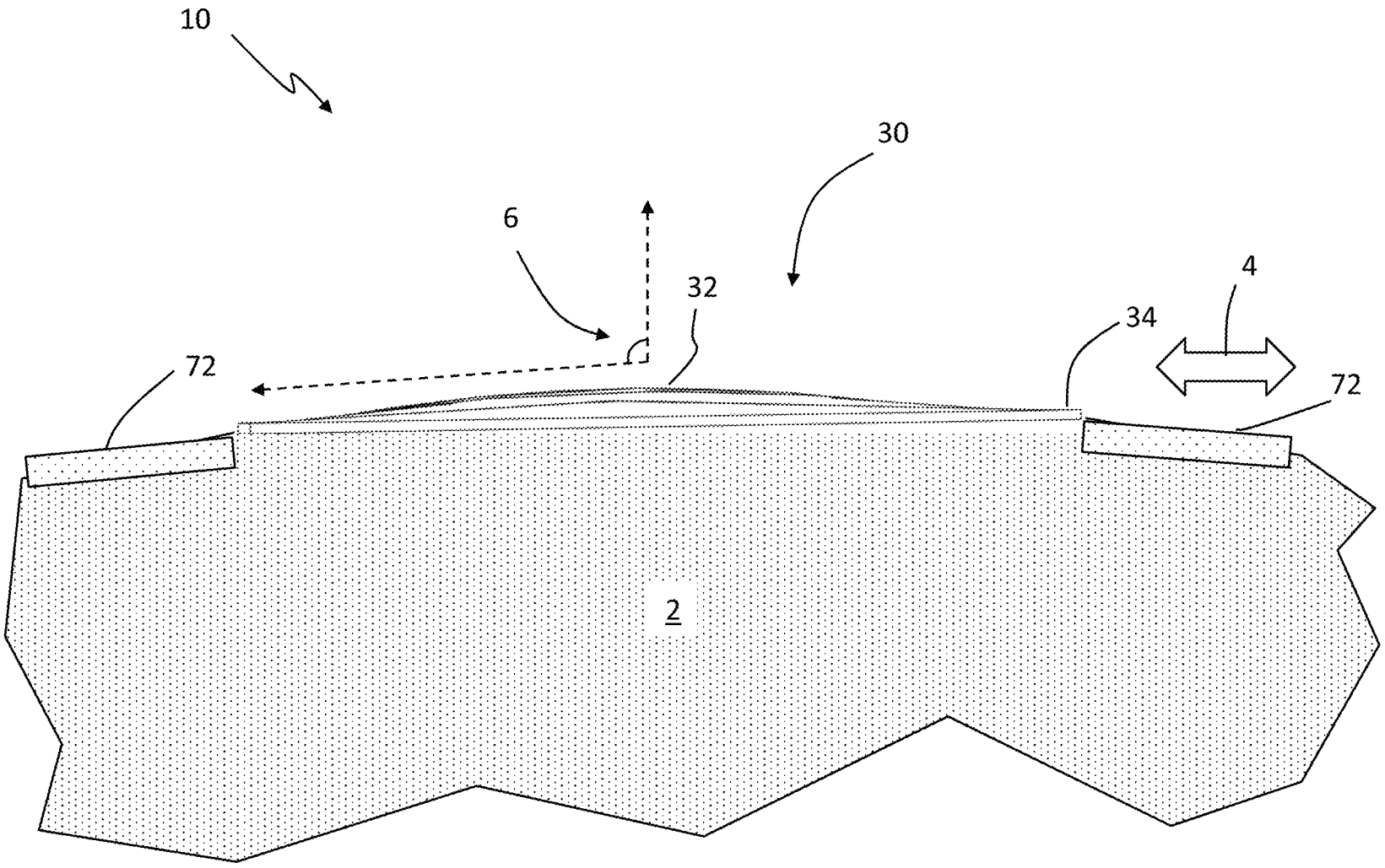

The tornado shelter apparatus 10 may be used to provide shelter to individuals within the path of a tornado or other weather event. As shown in FIG. 1, the shell 20 of the tornado shelter apparatus 10 is mounted at least partially below a ground surface 2, such that the general body of the shell 20 is positioned below the ground surface 2. FIGS. 2A-2B are side view illustrations of the tornado shelter apparatus cover 30, in accordance with the first exemplary embodiment of the present disclosure. The ground material removed to form the hole that the shell 20 fits within is then used to create an elevated wall 3 around sides of the shell 20, such that the opening 22 is positioned at or below the newly elevated wall 3 formed from the ground surface. This positioning allows the majority of the shell 20 to be positioned entirely below ground, with the opening 22 of the shell positioned higher than pre-construction ground level, yet still below the height of the elevated walls 3. The elevated walls 3 may then be tapered towards the normal ground surface, such as a taper extending 24-32 feet from the shell 20. In this way, the tornado shelter apparatus 10 is accessible from the ground surface 2 while the portion of the tornado shelter apparatus 10 positioned below the ground surface aids in providing safe shelter from a tornado. FIG. 2A shows the elevated wall 3 formed from the ground surface, which may be positioned on any number of sides of the apparatus 10, such as on three sides or all four sides, thereby allowing clearance to open the cover 30 on the fourth side. FIG. 2B shows a similar design, where the elevated wall 3 is formed from a concrete surround or skirt 72 which slopes away from the shell 20, thereby allowing clearance to open the cover 30 on the fourth side. The use of the elevated wall 3, whether formed from ground material, concrete, gravel, or another material, may prevent debris from directly contacting th side edges of the cover 30 or other, similar exposed portions of the apparatus 10.

The cover 30, as shown in FIGS. 1-2B, may be used for closing off access to the shell 20 and for preventing harmful tornado debris from hurting individuals within the shell 20. The cover 30 may have a slight arc shape with the middle portion 32 of the cover 30 being slightly higher than the edges 34 of the cover 30, as shown in FIGS. 2A-2B. In one example, the center of the cover 30 is approximately 6.0 inches taller than the edges of the cover 30. This dome shape of the cover 30 may contribute to a beneficial angle of deflection of tornado winds. Similarly, the slidable opening of the cover 30 along with the position of the opening 22 of the shell 20 and cover 30 at or near a ground surface 2, allows for other improvements in tornado safety. The cover 30 may have a variety of other design features, such as being formed circular, being a faceted dome, having one or more struts positioned on either side of the cover 30 to increase strength.

Figure 4:
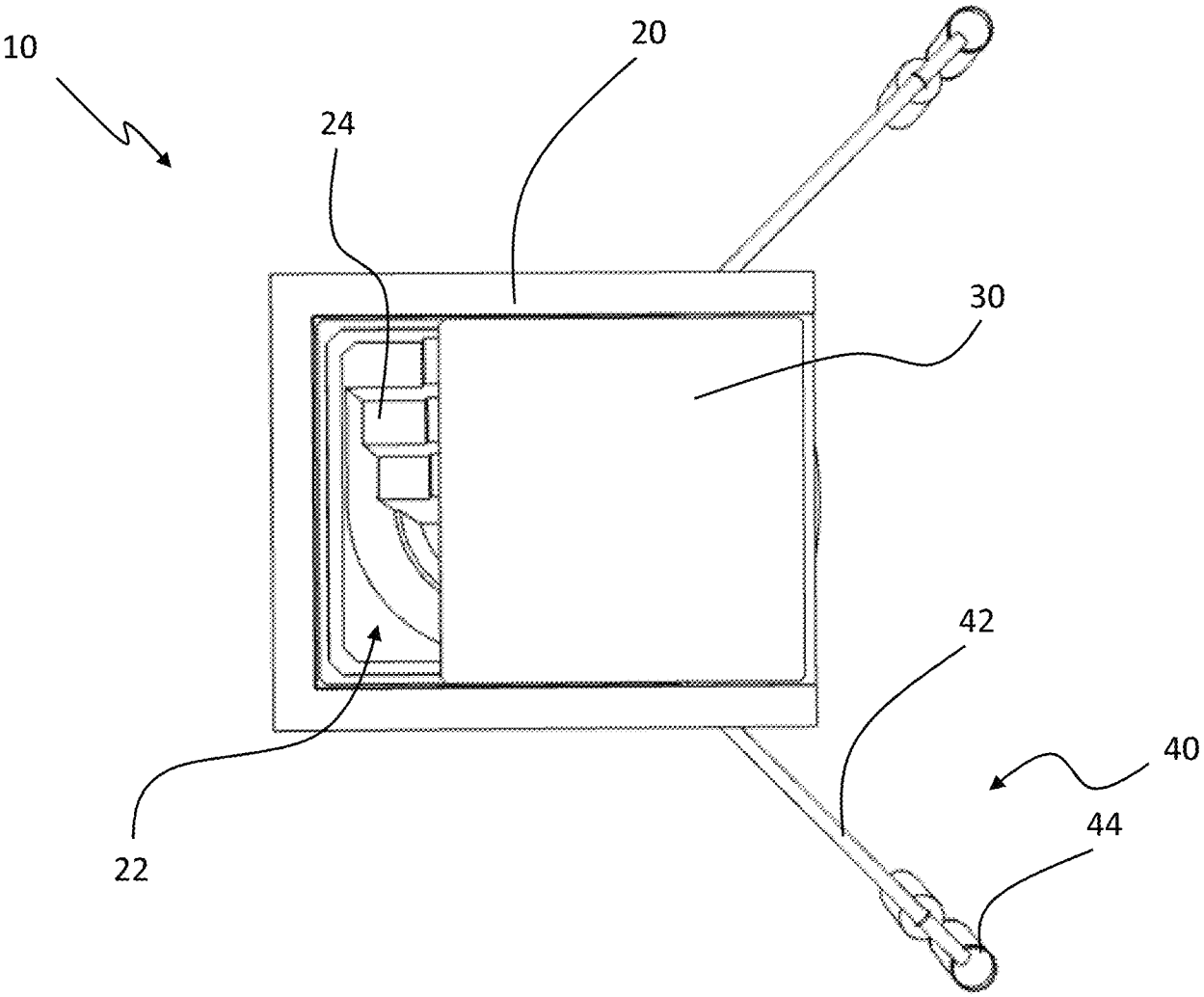
FIG. 4 is a top view illustration of the tornado shelter apparatus, in accordance with the first exemplary embodiment of the present disclosure.

As is known in the art, tornados can have very strong horizontal winds which move parallel to the ground's surface, as shown at 4. Naturally, these winds also have some vertical force to them, but the substantial force which can cause injury during tornados is due to the high speed horizontal winds which have the ability to move objects, such as building debris, cars, and farm equipment. Many conventional tornado shelters use doors, hatches, or openings with a pivotal or hinged design, but these structures are susceptible to problems during a tornado. For example, hinged or pivoting doors can be blown open when shut, or if not shut, the force of the horizontal wind can prevent someone from shutting them. In contrast to these designs, the tornado shelter apparatus 10 uses a cover which is slidable between a closed position where the cover 30 is overlapping the opening 22 of the shell 20, and an open position where the cover 30 is at least partially removed from the opening 22 of the shell 20 (FIG. 4). The sliding movement of the cover 30 allows for greater control of shutting the cover during the high winds of a tornado, since only the small, side edge of the cover 30 needs to move against the horizontal wind force 4, whereas with conventional hinged or pivoting doors, the large face of the door needs to be moved against the horizontal wind force 4. To achieve the ability for the cover 30 to slide, opposing edges of the cover 30 may be positioned within a metal frame, such as a stainless steel channel frame, which allows the cover 30 to be moved along the length of the frame in only two directions (back and front). In one example, the frame may be constructed from $1/16^{th}$ inch plate stainless steel, so as not to rust while providing a strong structure for retaining the cover 30.

The arced shape of the cover 30 also contributes to increased tornado safety by providing a beneficial angle of deflection 6 of the tornado wind. As the wind force 4 applies a horizontal force across the cover 30, the slight arced or dome shape of the cover 30 acts to minimize the force transferred from the wind to the cover 30. In other words, the arced shape 30 of the cover allows the wind 4 to move over the cover with minimal resistance, thereby increasing the likelihood that the structural integrity of the cover 30 can withstand the strong wind force 4. In addition to deflecting the wind force, the shallow height dome provides for a low angle of deflection for any object being hurled at the cover 30. Such an object which hits the cover 30 will deflect off and upward and outward versus a more vertical or non-flat angled surface which would create a situation where the impediments would collide with the surface and cause a crashing affect versus a deflection.

The shallow dome shape of the cover 30 may also provide additional strength and support versus a flat top which would be susceptible to collapsing from its own weight and/or debris positioned on the cover. Additionally, the plastic forming a flat cover, when exposed to the elements and sun long term, may be susceptible to sagging downward and creating an inverted dome which would collect water. People or animals walking across a flat cover could cause the top to collapse inwardly. While people or animals walking on the cover 30 is not recommended, the crowing of the shallow dome shape of the cover 30 may be sufficient to support the weight of a person or light animal without damage.

Additionally, the position of the shell 20 in the ground 2 may be such that the upper rim of the shell 20 is located substantially 1 foot above the ground surface during an initial install. Then, dirt and other material may be used to backfill around the exposed edge of the shell 20. Maintaining this elevated height, relative to the surrounding land the tornado shelter apparatus 10 helps prevent flooding within the interior of the shell 20. The fact that the apparatus 10 is positioned at least partially underground may also provide a psychological benefit to users. Occupants of conventional tornado bunkers positioned above the ground often endure a terrifying experience when a tornado is present, since the effects of the tornado, e.g., debris, wind, noise, etc., are directly acting on the shelter, often without any intermediary protection. In contrast, these effects may be decreased or eliminated by the positioning of the apparatus 10 within the ground, whereby the ground lessens noise, blocks wind, and obstructs debris. By lessening the psychological, more individuals are apt to use a tornado shelter and have a better experience.

Figure 3:
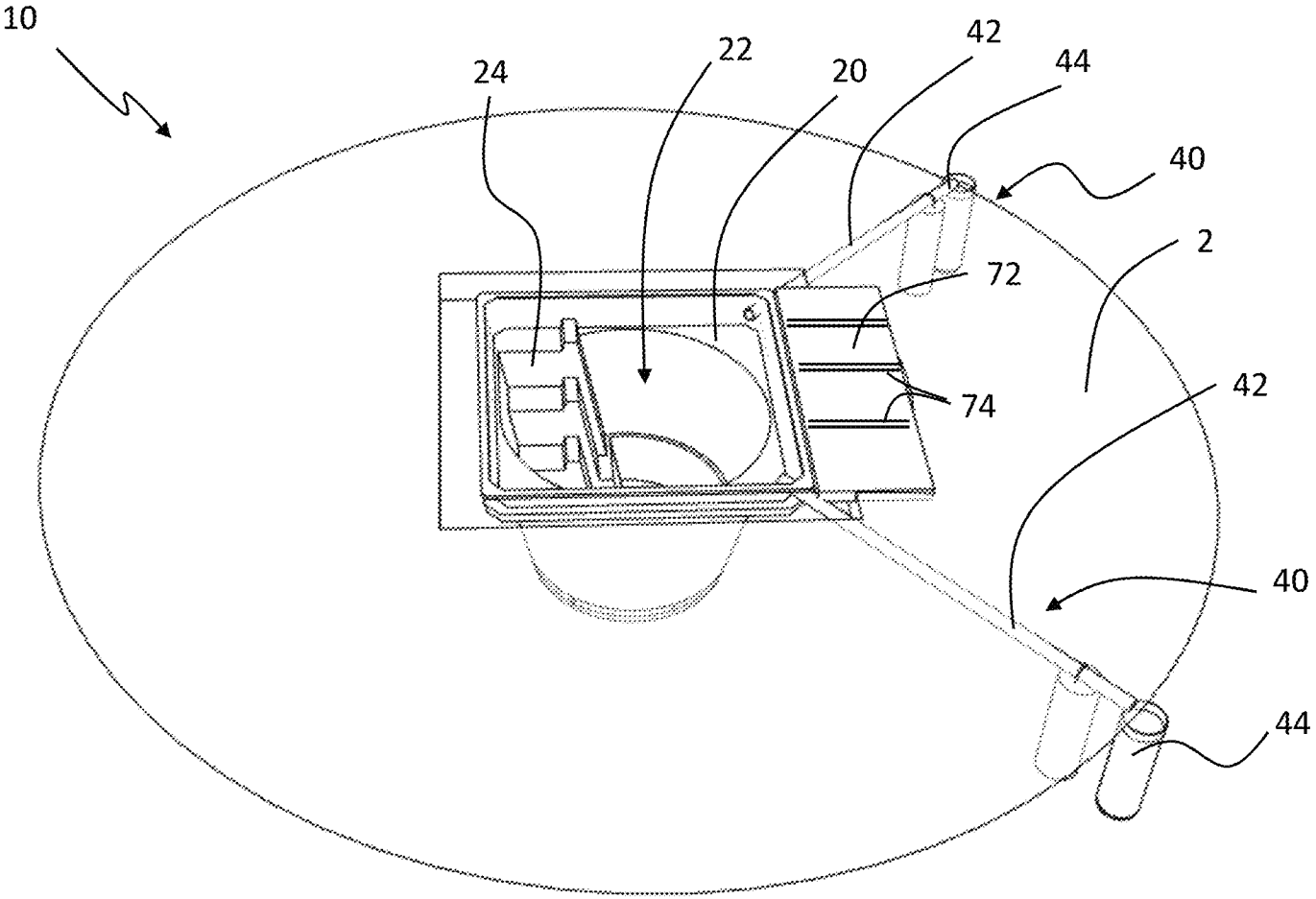
FIG. 3 is an elevated side view illustration of the tornado shelter apparatus without a cover, in accordance with the first exemplary embodiment of the present disclosure.

The tornado shelter apparatus 10 may have a number of unique and beneficial features and designs. FIG. 3 is an elevated side view illustration of the tornado shelter apparatus 10 without a cover 30, in accordance with the first exemplary embodiment of the present disclosure. FIG. 4 is a top view illustration of the tornado shelter apparatus, in accordance with the first exemplary embodiment of the present disclosure. With reference to FIGS. 1-4 together, the shell 20 of the tornado shelter apparatus 10 generally includes a unitary or one-piece structure which is molded or otherwise manufactured to have a specific shape which is conducive for housing individuals, namely human beings, but also certain animals. The shell 20 has the general shape of a truncated cone, with an upper portion of the shell 20 having an opening 22 for gaining access to an interior volume of the shell 20. The base of the shell 20, which may have a diameter which is less than a diameter of the shell 20 at the opening, may have a floor which is molded together with the sidewalls of the shell 20. The shell 20 may be a single unitary molded piece, or it may comprise a multi-part shell 20, such as where there are inner and outer shell parts which are used in conjunction with one another. For example, the shell 20 can include inner and outer shell skins which have a void or space therebetween, where the space is filled with a durable foam or concrete.

In one example, the shell 20 extends interior at approximately a 14° angle, which allows for nesting a plurality of shells 20 together for economical transportation. The angled design of the shell 20 may allow for it to be manufactured in a factory setting with economical shipping by nesting a plurality of shells 20 together on a transport vehicle. This results in a lower cost to consumers, thereby increasing the likelihood that more consumers can install and use the apparatus 10. Additionally, due to the materials used in construction, the apparatus 10 may cost lower than many conventional tornado shelters while providing some of the added benefits of these higher cost shelters. For example, the use of a moldable HDPE plastic and/or HDPE foam may allow for the inclusion of stairs with the apparatus 10 at the same price point as conventional devices provide ladders, which allows individuals with physical impairments to use the apparatus 10 more successfully than they could use conventional shelters like concrete bunkers with ladders. While the figures of this disclosure depict a specific shape of the shell 20, the shell 20 may also have other shapes and designs, such as round, hexagonal, octagonal, or otherwise, all of which are included within the scope of the present disclosure.

As can be seen in FIG. 3, the shell 20 may have a plurality of stairs 24 or other means of egress from the shell 20 which are molded into the shell wall itself. In one example, the stairs 24 may include 3 or more stairs which are formed along a sidewall of the shell 20, where each stair 24 has a stepping portion and a raised edge portion which helps a user climb into and out of the shell 20 interior. In other examples, other devices can be used to assist users with climbing into or out of the shell 20, such as ladders, hand holes, ropes, slides, or any other structure. Also, shown in FIG. 3, the concrete skirt 72 may be positioned proximate to the shell 20, and along the rear side of the shell 20 where the cover (not shown) moves, a plurality of low-friction members 74 can be installed in the concrete skirt 72 to prevent damage to the cover.

The tornado shelter apparatus 10 may also include airflow devices 40. As shown in FIG. 3, the airflow devices 40 may include a length of pipe or tubing 42 which is positioned near the top of the shell 20 interior. These pipes 42 may be sloped away from the shell 20, such that gravitationally-transported water cannot move through the pipes 42 and into the shell 20. At the outer position of the pipe 42, i.e., away from the shell 20, one or more containers 44 may be positioned. These containers 44 may act as receptacles for ensuring the pipes 42 have a constant supply of air. The pipe 42 may also be used as an early warning for flooding, whereby if water is flowing uphill through the pipe 42 into the shell 20, occupants of the apparatus 10 have an indication to evacuate the apparatus 10 prior to it flooding fully.

Figure 5:
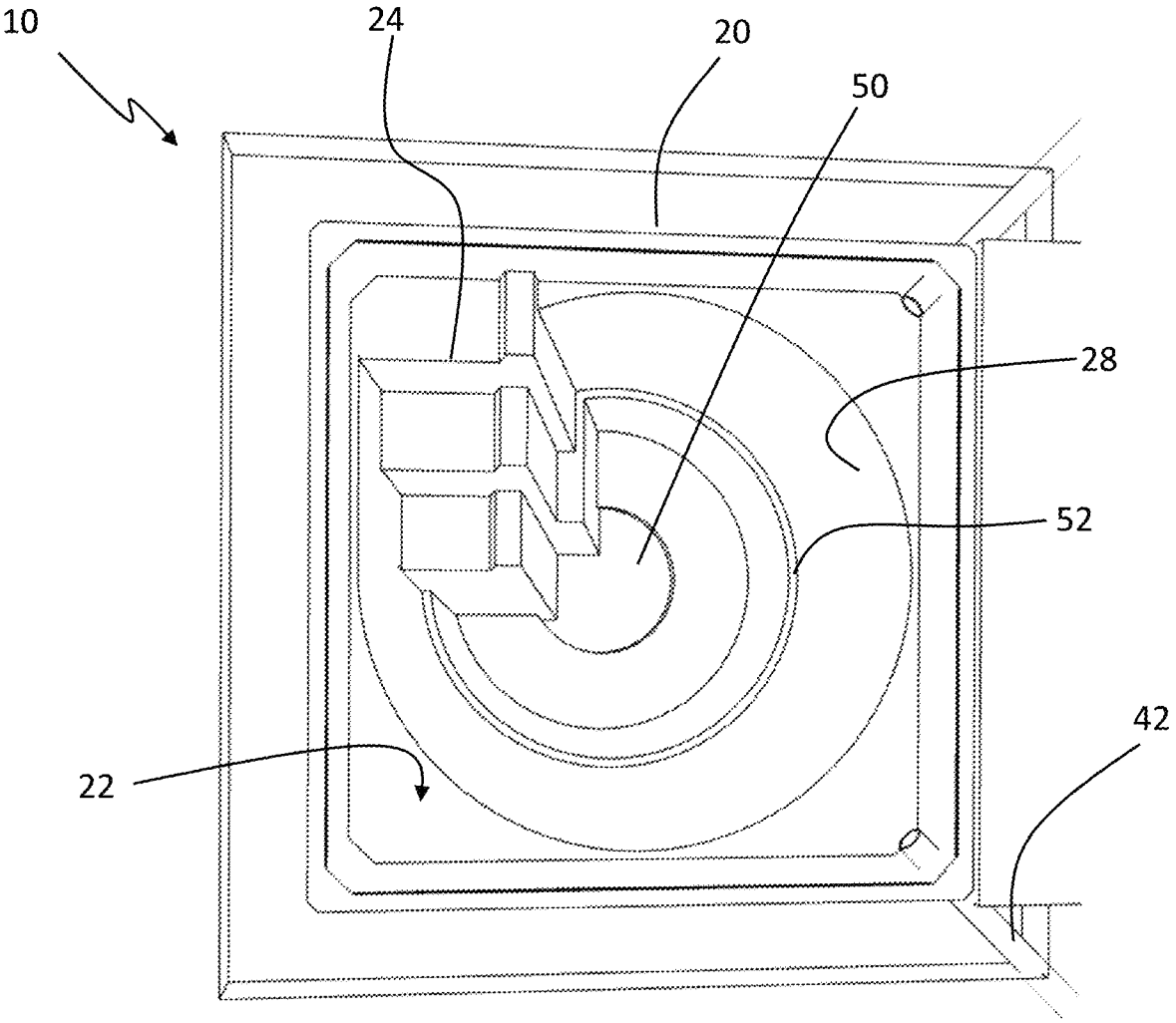
FIG. 5 is a detailed, top view illustration of the tornado shelter apparatus without a cover, in accordance with the first exemplary embodiment of the present disclosure.
Figure 6:
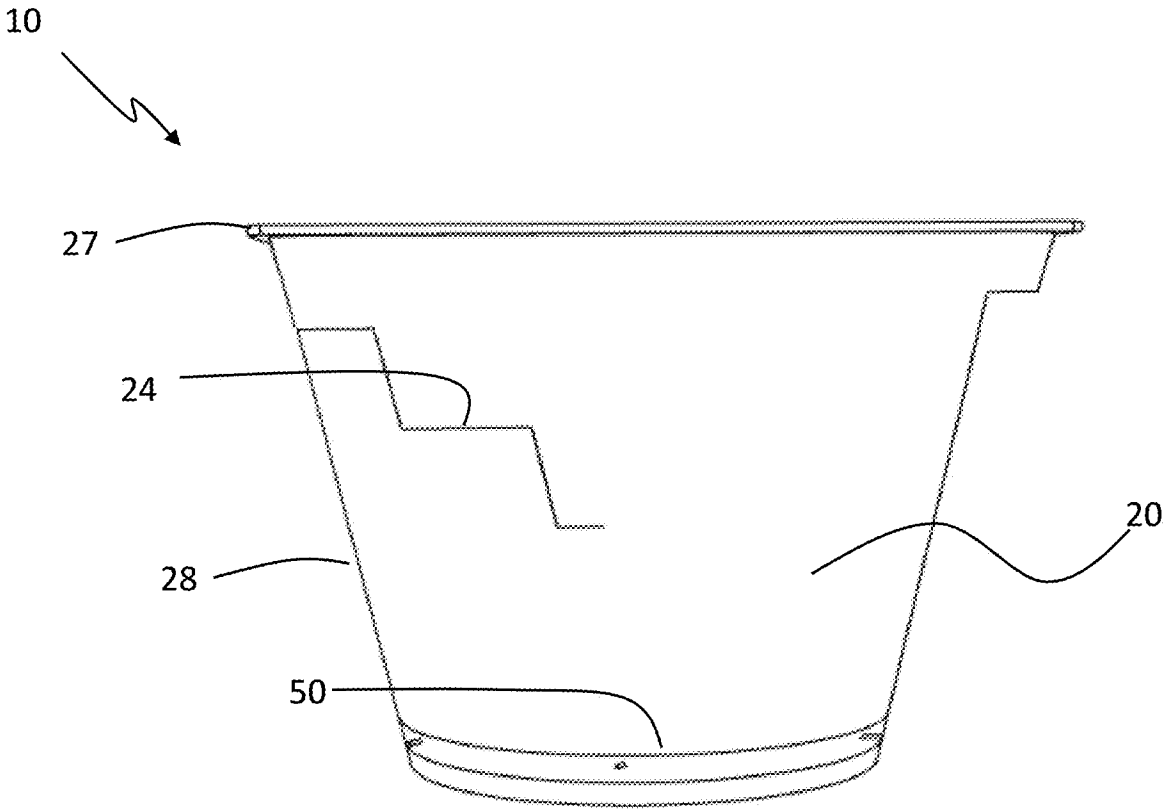
FIG. 6 is a side view illustration of the tornado shelter apparatus without a cover, in accordance with the first exemplary embodiment of the present disclosure.
Figure 7:
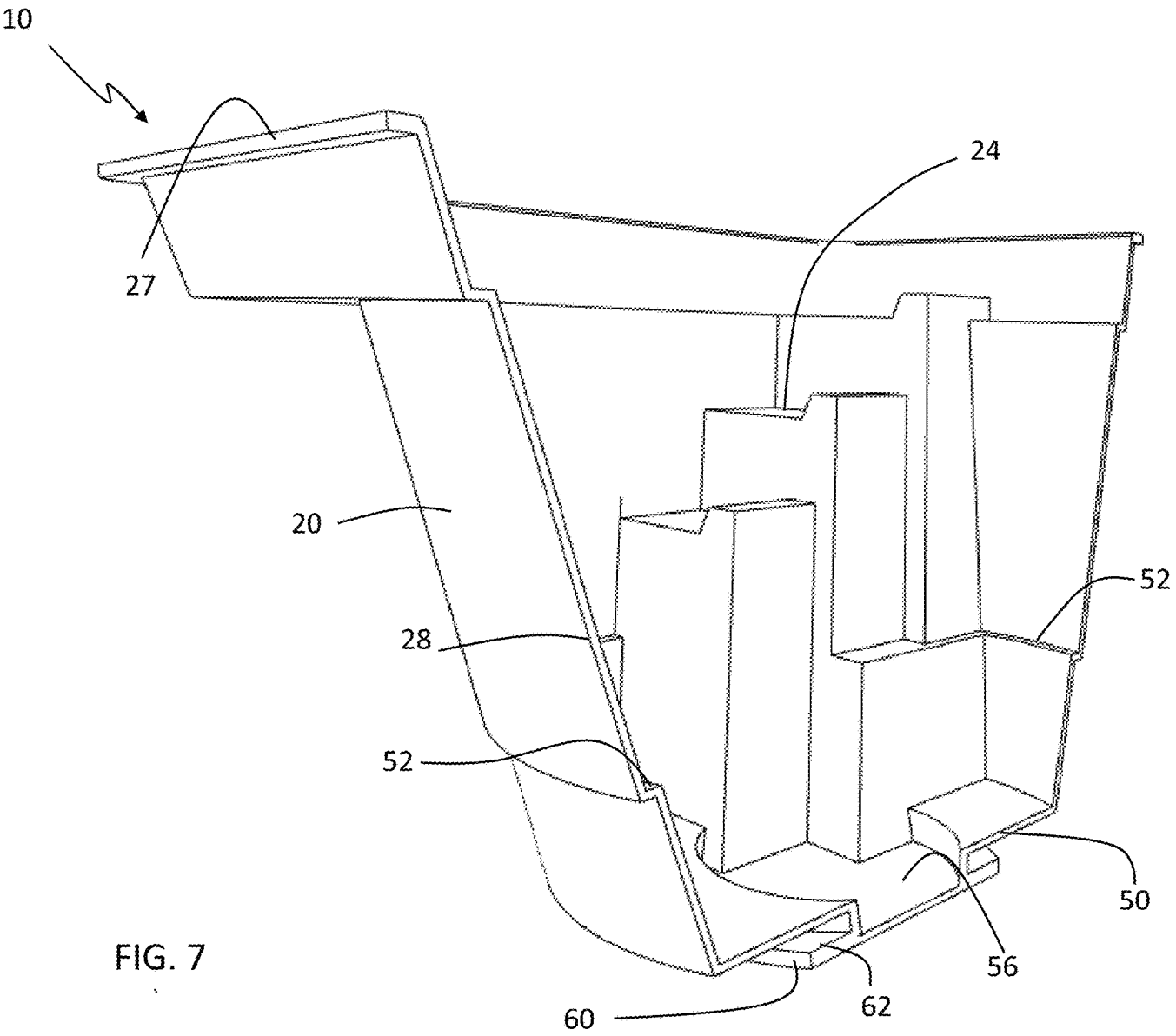
FIG. 7 is a cross-sectional side view illustration of the tornado shelter apparatus without a cover, in accordance with the first exemplary embodiment of the present disclosure.
Figure 8:
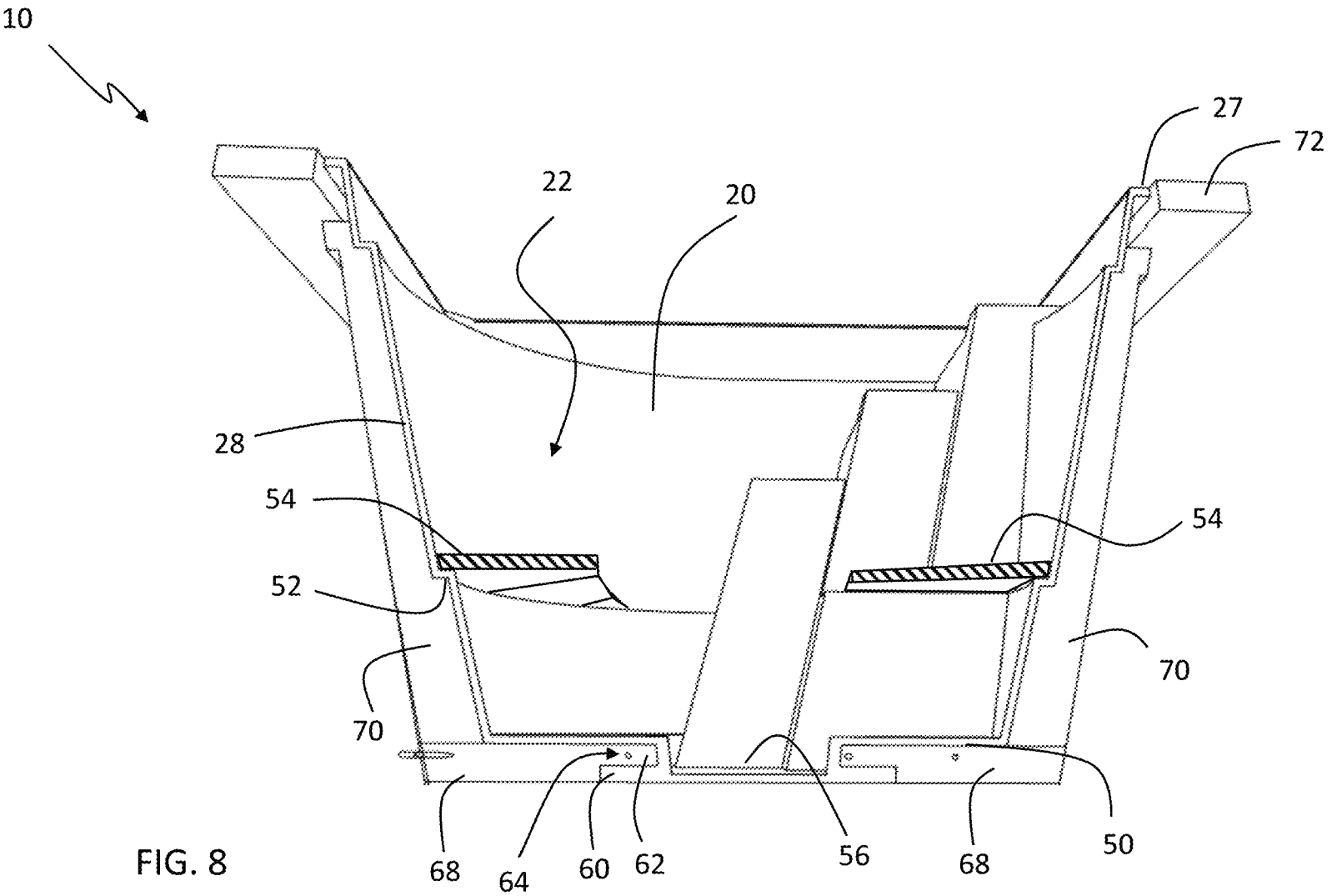
FIG. 8 is a cross-sectional side view illustration of the tornado shelter apparatus without a cover and with installation materials, in accordance with the first exemplary embodiment of the present disclosure.

FIGS. 5-8 are illustrations which depict the shell 20 in greater detail. Specifically, FIG. 5 is a detailed, top view illustration of the tornado shelter apparatus without a cover, in accordance with the first exemplary embodiment of the present disclosure. FIG. 6 is a side view illustration of the tornado shelter apparatus without a cover, in accordance with the first exemplary embodiment of the present disclosure. FIG. 7 is a cross-sectional side view illustration of the tornado shelter apparatus without a cover, in accordance with the first exemplary embodiment of the present disclosure. FIG. 8 is a cross-sectional side view illustration of the tornado shelter apparatus without a cover and with installation materials, in accordance with the first exemplary embodiment of the present disclosure.

With reference to FIGS. 5-8, the interior of the shell 20 may have a number of features beyond the stairs 24. For example, as the sidewall 28 of the shell 20 angles inwards to the bottom 50 of the shell 20, one or more ledges 52 may be formed in the sidewall 28. The ledges 52 may be used to impart additional structural integrity into the shell 20 and act as a structure for placing a seat upon. For example, as shown in FIG. 8, one or more rigid boards or other material may be positioned along the interior of the shell 20, with ends resting on the ledges 52, to provide a bench or seat to occupants of the shell 20. Here, the ledges 52 support the weight of the boards 54 along with any individuals sitting on the boards 54. In one example, the boards 54 are formed to create a circular or semi-circular bench, such that the location corresponding to a center point of the shell 20 remains open. This arrangement allows for a number of individuals to sit on the board 54 with their feet in the center trough 56, aiding an individual with moving around within the shell 20.

Figure 10:
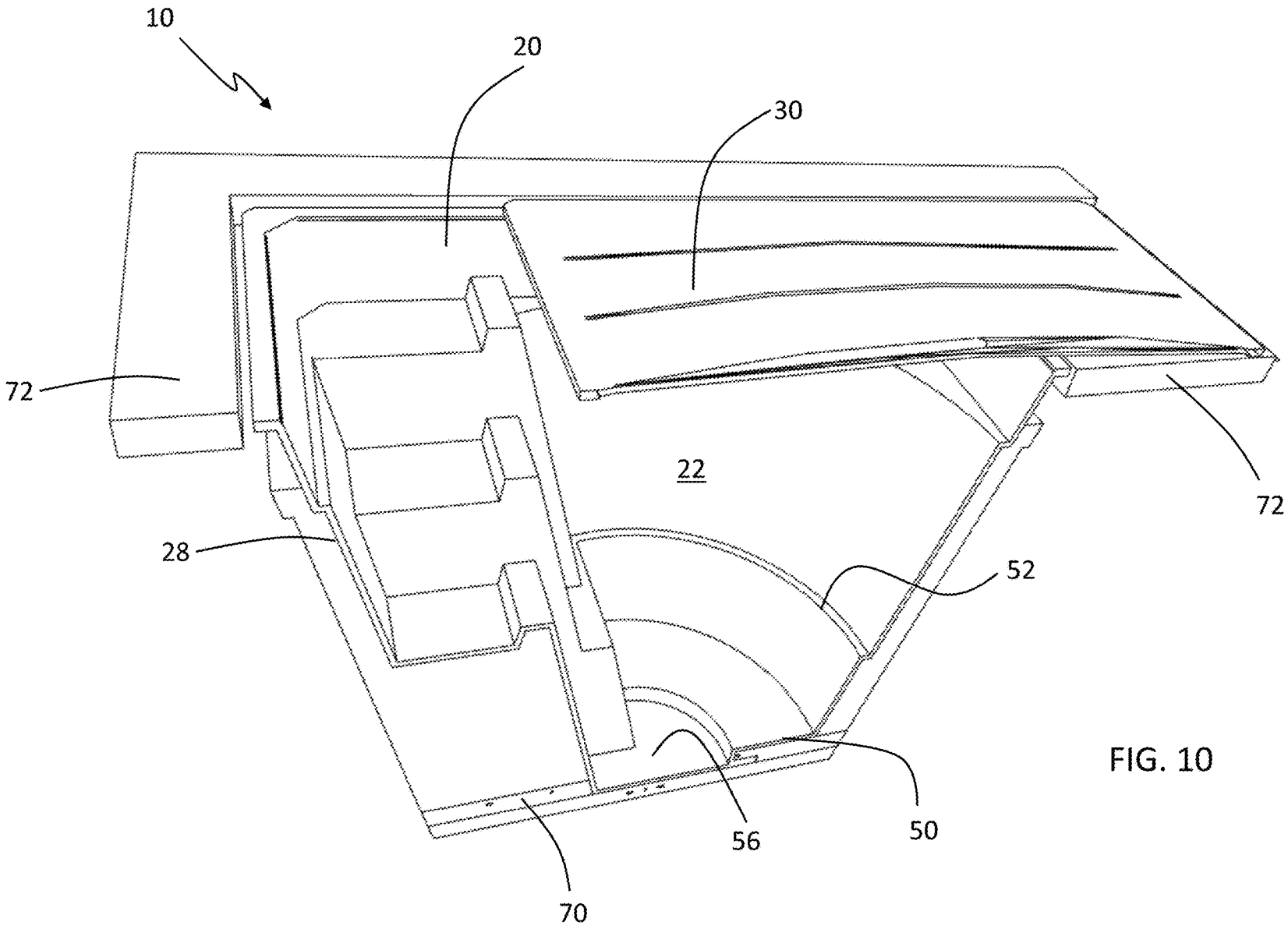
FIG. 10 is a cross-sectional side view illustration of the tornado shelter apparatus, in accordance with the first exemplary embodiment of the present disclosure.

The size of the features of the shell 20 may vary, depending on the design of the tornado shelter apparatus 10. For example, the thickness of the shell may be 0.25 inches, 0.5 inches, 0.625 inches, or any other thickness dimension. The overall height of the shell 20 may be approximately 6.0 feet tall overall to a center point of the cover 30, and the sidewalls of the shell 20 being substantially 5.5 feet with approximately 1.5 feet from the base 50 to the ledge 52 and approximately 3.0 feet from the ledge 52 to the top of the stairs 24. From the top of the stairs 24 to the flange of the shell 20 may be approximately 1 foot. The distance the cover 30 opens, as shown in FIG. 10, may be a 32.0 inches opening, as measured from the edge of the cover 30 to the terminating edge of the shell 20. Optionally, at this location of the shell 20 (32.0 inches from the edge), a strut may be positioned across the top of the shell 20, which may act as a stop for preventing the cover 30 from opening further. This strut, if used, or the angled metal members discussed relative to FIGS. 11-14, may provide additional support to the cover 30 as occupants entering the shell 20 are likely to use the edge of the cover 30 as a handrail while entering the shell 20. The footprint of the shell 20 may be 8.0 feet by 8.0 feet in one example, but in other examples the shell 20 may be smaller or larger. It is also noted that any number of vertical or horizontal struts or ridges may be molded into the shell 20 to increase its strength. It may also be possible to mold seats, benches, storage areas, etc. in the shell 20.

Construction of the shell 20 may be achieved by a variety of techniques, such as by mold-forming the shell 20, and in particular, rotomolding the shell 20 from a plastic, fiberglass, or other suitable material. For example, the shell 20 may be constructed from High-density polyethylene (HDPE) plastic, a combination of HDPE plastic and HDPE foam formed together, and/or a combination of HDPE plastic with an interior HDPE foam layer. Different materials and arrangements of the materials may be used to provide a shell 20 with increased strength or other material properties while decreasing a weight as much as possible. The HDPE material(s) may also provide an excellent resiliency to help minimize any damage from tornado debris. For example, lumber and other building materials which can be thrown at the shelter 10 during a tornado can have a substantial damaging impact upon conventional shelters. Testing facilities utilize 2×4's in their testing as it closely replicates real world scenarios. The combination with the resiliency of HDPE or similar materials, along with the minimum exposed surface area created by the shallow dome cover 30, minimizes those impacts. Additionally, the shallow dome cover 30 may include one or more cross-over or structural members, such as those formed from metal or other structurally rigid materials, which can be placed along or across the cover 30 to provide additional structural support to the cover 30. In particular, these structural supports may be used to prevent weighted objects, such as human beings, farm animals, etc., from collapsing the cover 30 if it is stood upon.

Additionally, the shell 20 may be nested with other shells during transportation of storage, which can lessen the costs of shipping and storing the tornado shelter apparatus 10, which in turn, may allow for a more affordable product compared to cast concrete shelters. In one example, the shell 20 may be constructed from a glow-in-the-dark material, such that additional illumination can be provided to occupants while inside. It is also noted that the shell 20 may be free from holes or other apertures in all parts of the shell 20 which are intended to be positioned underground in order to decrease the possibility of water infusion or the formation of cracks, such that the shell 20 remains waterproof or watertight in all subterranean locations.

As shown in FIGS. 7-8, a lip 60 or detent may be formed at the bottom edge of the shell 20, such that an annular recess 62 is formed between the bottom 50 of the shell 20 and the lip 60. This annular recess 62 may be used for ensuring that the tornado shelter apparatus 10 remains positioned in the ground during a tornado. The size or diameter of the lip 60 and the annular recess 62 may vary, depending on design. For example, in FIG. 7, the lip 60 may be smaller than the bottom floor 50 of the shell 20, but it is also possible for the lip 60 to be approximately the same diameter as the floor 50, as shown, for instance, in FIG. 6. The size of the lip 60 may be selected to ensure that the shells 20 can be nested during transportation.

The size of the lip 60 may also aid in retaining the shell 20 within the ground, during both installation and permanent use. For example, as shown in FIG. 8, a quantity of rebar 64, or other structural metal rod, may be positioned in the annular recess 62 to interface the shell 20 with a quantity of concrete used as a footing for the tornado shelter apparatus 10. The concrete may include various layers or levels of concrete. For example, as shown in FIG. 8, once the shell 20 with rebar 64 is positioned within the hole, a quantity of concrete 68, such as 25 bags in one example, may be poured along the edges of the hole such that the concrete flows towards the lip 60, thereby engulfing the annular recesses 62 and the rebar 64. Once this initial quantity of concrete 68 is complete, the shell 20 will be prevented from floating upwards. Then, optionally, additional concrete can be poured along the sidewalls of the shell 20 to effectively encapsulate the sidewalls 28 of the shell 20. A quantity of concrete 70 may also be used to line the sidewalls of the shell 20, as shown. Optionally, instead of filling the sidewall void with concrete, it may be possible to backfill rocks, gravel, dirt, or other materials along the sidewall 28. A concrete skirt 72 can be added along the upper flange of the shell 20.

Figure 9A:
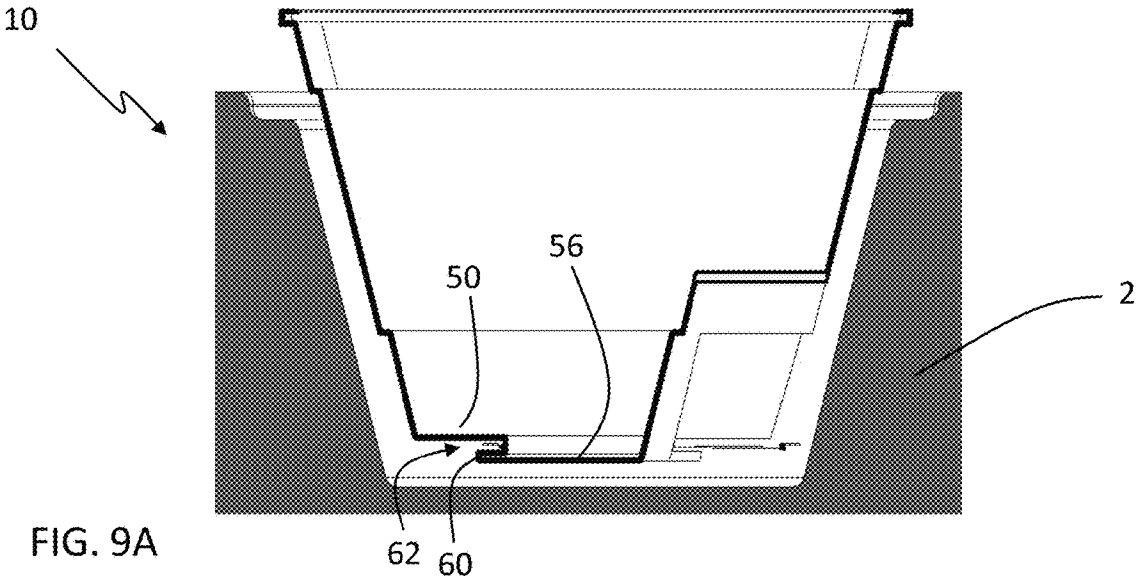
FIGS. 9A-9D are cross-sectional side view illustrations of the tornado shelter apparatus without a cover and showing a progression of installation, in accordance with the first exemplary embodiment of the present disclosure.
Figure 9B:
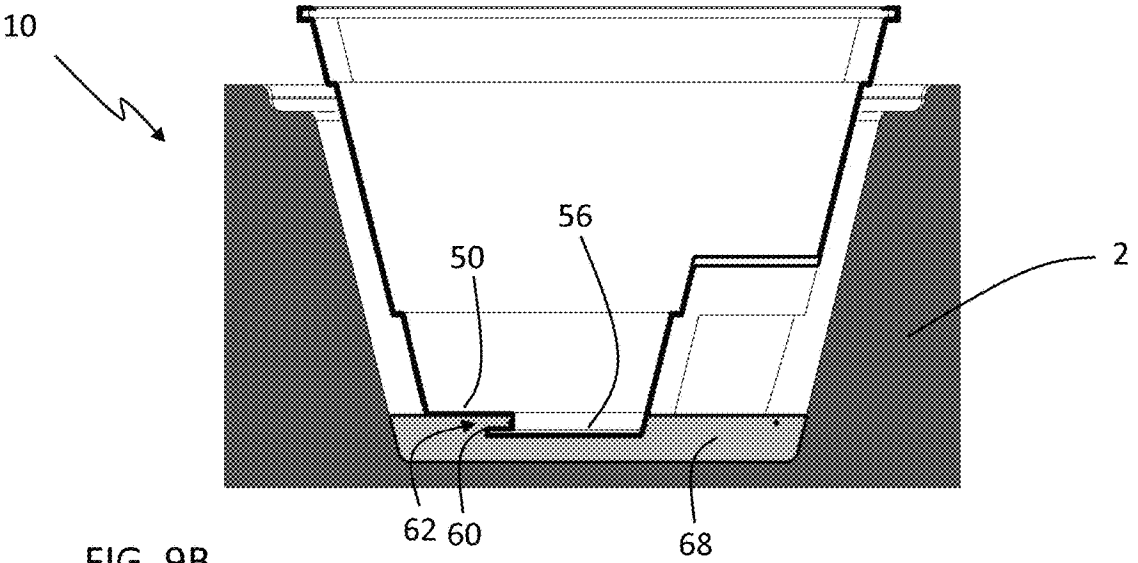
Figure 9C:
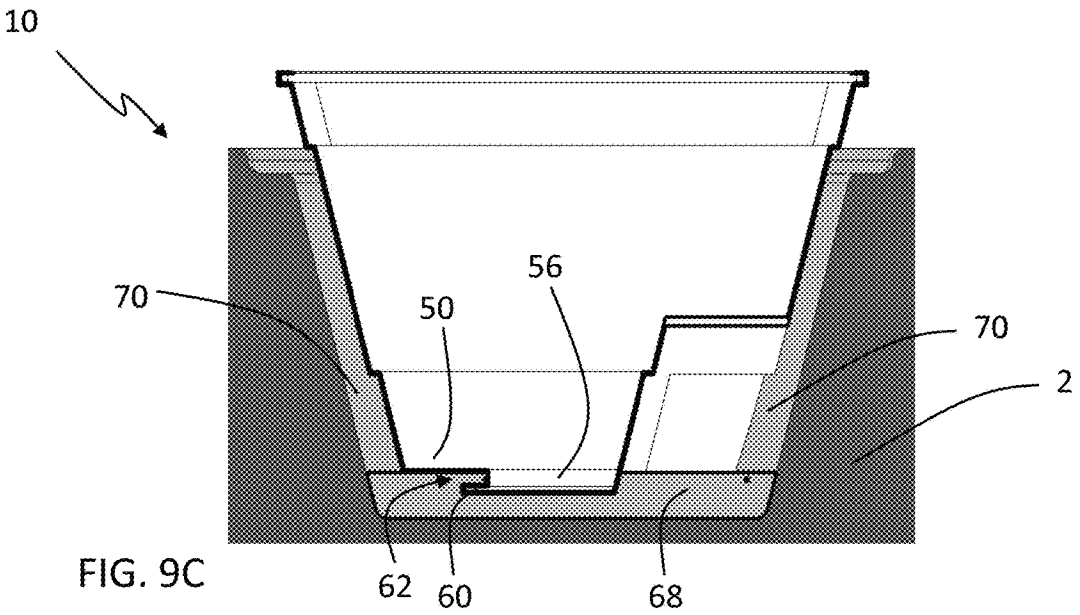
Figure 9D:
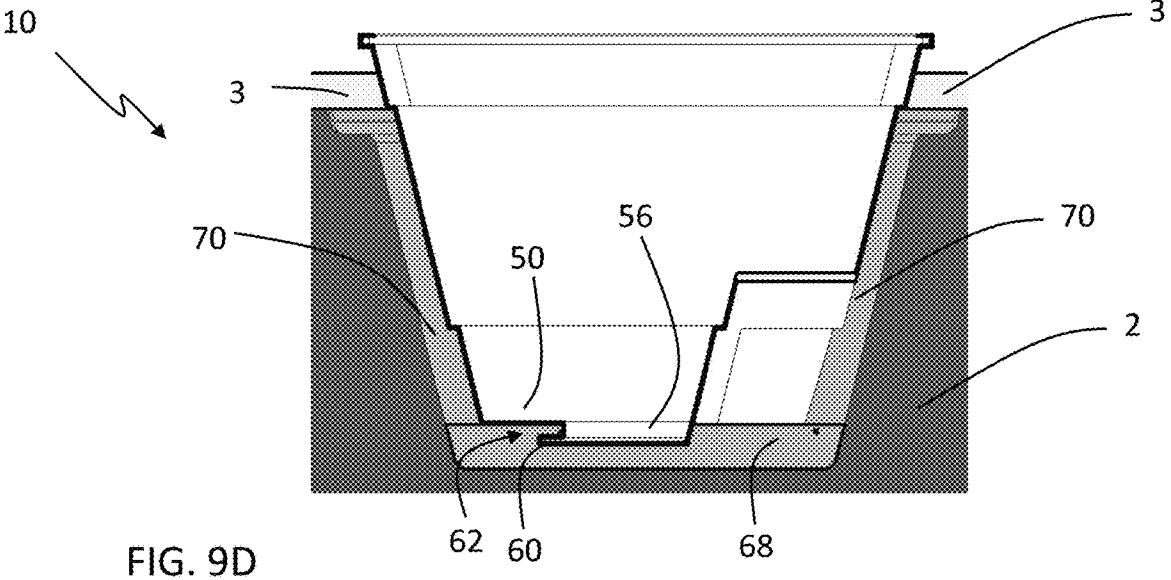

FIGS. 9A-9D are cross-sectional side view illustrations of the tornado shelter apparatus 10 without a cover and showing a progression of installation, in accordance with the first exemplary embodiment of the present disclosure. In particular, FIG. 9A illustrates the apparatus 10 when it is positioned within a hole within the ground 2, such that the lower portion of the apparatus 10 is in a position below the surface of the ground 2. This may be the first installation step. In FIG. 9B, the concrete 68 may be poured, such that the concrete 68 contacts the bottom portion of the apparatus 10, in particular, around the lip 60 and within the annular recess 62 where the rebar is located. Once cured, this concrete 68 may provide substantial weight to prevent the apparatus 10 from moving or being lifted upwards during a tornado or similar storm. Then, as shown in FIG. 9C, the additional concrete 70, or optionally rocks, gravel, dirt, or another fill material, can be poured in along the sidewalls of the apparatus 10, such that the concrete 70 substantially fills the void between the external sidewall of the apparatus 10 and the interior wall of the hole within the ground 2. In FIG. 9D, once the concrete 70 is cured, the elevated wall 3 or berm may be installed, such that the ground surface is positioned substantially flush with the cover 30, i.e., positioned slightly above, at, or slightly below the cover 30 or the flange of the apparatus 10.

Other concrete structures may also be used, such as a skirt 72 or wall positioned around the upper edge of the shell 20, as shown in FIG. 10, which is a cross-sectional side view illustration of the tornado shelter apparatus 10, in accordance with the first exemplary embodiment of the present disclosure. As shown, a skirt 72 formed from concrete or a similar material may be placed about the circumference of the apparatus 10, or about a portion of the circumference of the apparatus 10. When the cover 30 is opened, a portion of the cover 30 may be positioned over the skirt 72, whereby the skirt 72 can act to support the weight of the cover 30. In place of a concrete skirt 72, it is also possible to omit concrete around the edge of the flange of the shell 20, and instead use ground material, gravel, or another material around the upper edge of the shell 20.

It is also noted that the lip 60 may be used during transportation and storage of the shells 20. For example, the presence of the lip 60 may prevent two shells 20 from being stuck together but eliminating or minimizing suction created between two nested shells 20. Additionally, the lip 60 may be used for separating two nested shells 20 from one another, whereby prongs of a forklift can be positioned between the lip 60 and the bottom 50 to move a shell 20 or separate it from another shell 20.

Figure 11:
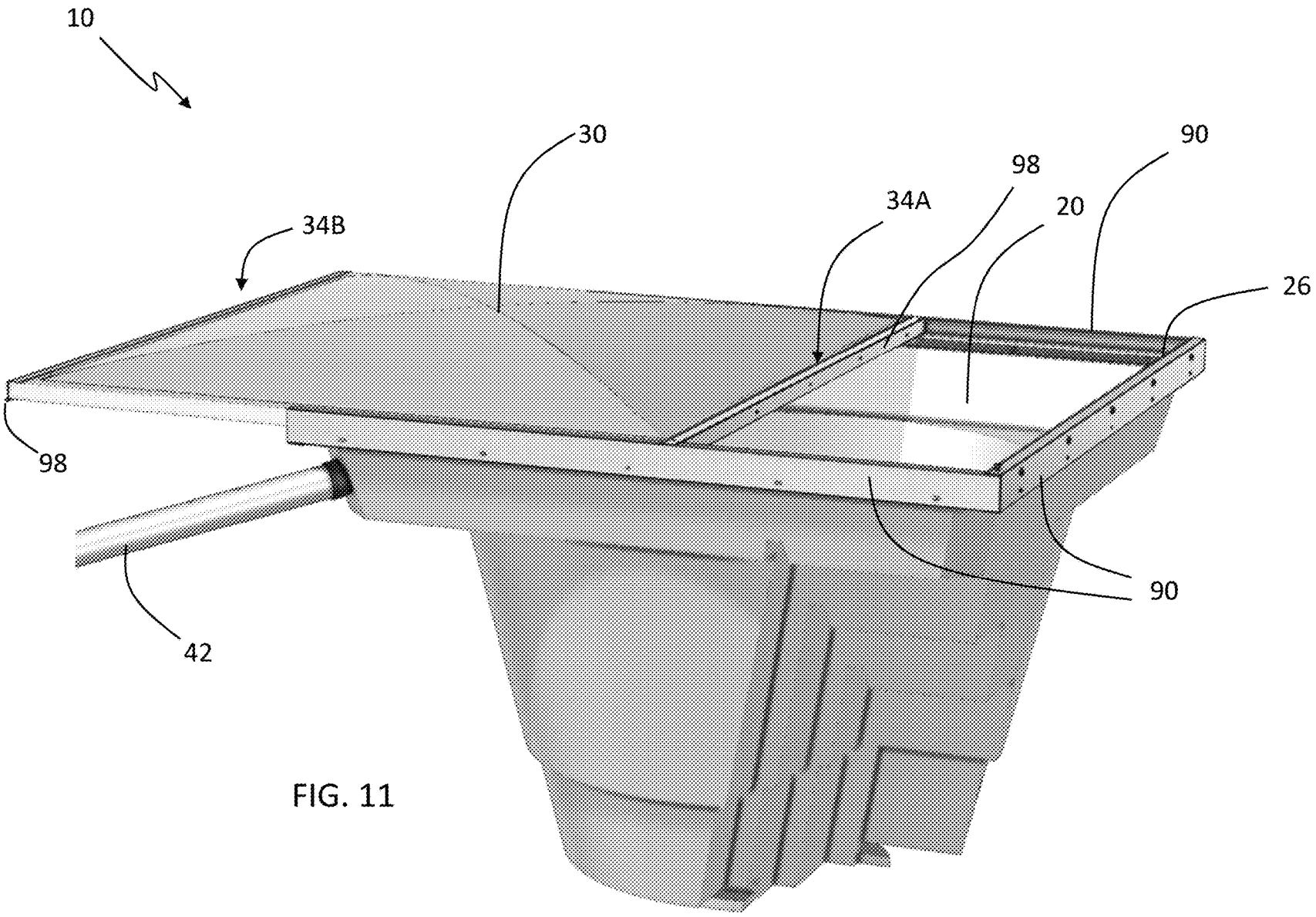
FIGS. 11-12 are top plan view illustrations of the tornado shelter apparatus, in accordance with the first exemplary embodiment of the present disclosure.
Figure 12:
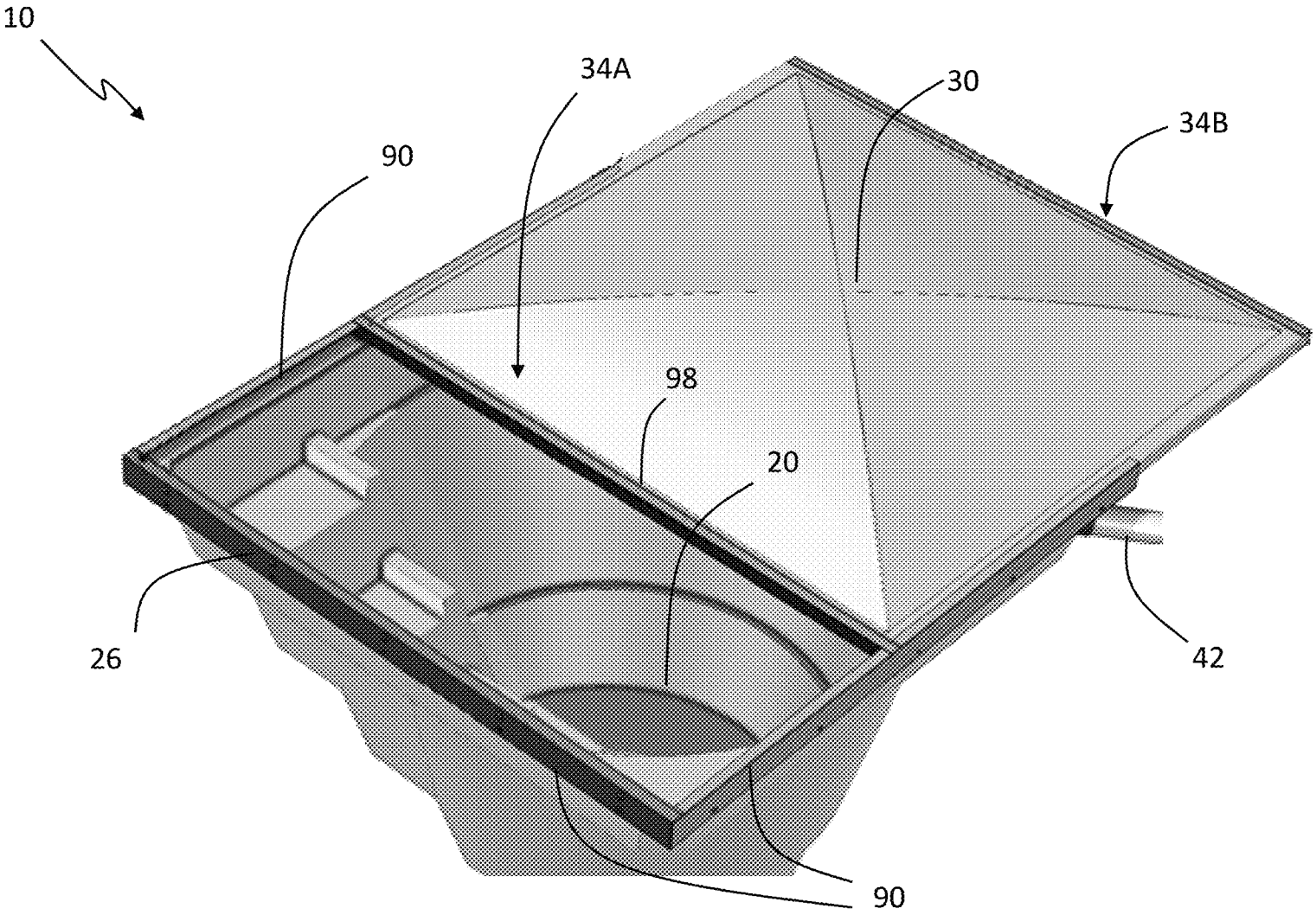

With regards to the cover 30, there are various methods and techniques for securing it to the shell 20 of the apparatus 10 yet allowing it to open and close as needed for people to take up occupancy within the apparatus 10. FIGS. 11-12 are top plan view illustrations of the tornado shelter apparatus 10, in accordance with the first exemplary embodiment of the present disclosure. In particular, FIGS. 11-12 depict the apparatus 10 with the cover 30 partially open, whereby the cover 30 is removed from the front edge 26 of the shell 20. In this embodiment, the cover 30 is movable relative to the shell 20 through a system of metal channels in which the cover 30 is positioned and can move. For example, as shown in FIGS. 11-12, a U-shaped channel 90 is positioned around three or more sides of the shell 20, e.g., the sides and the front, where the U-shaped channel 90 is positioned on an edge thereof, whereby the open portion of the U-shaped channel 90 faces inwards. The terminating, lateral or side edges of the flange 27 of the shell 20 and the terminating, lateral or side edges of the cover 30 are positioned within the U-shaped channel 90, whereby the U-shaped channels 90 guide a sliding movement of the cover 30 relative to the shell 20. The U-shaped channels 90 may be bolted or otherwise fastened to the flange 27 of the shell 20, such as, for example, with 10 mm TORX® bolts with flange heads, which gives more support to the cover 30 to ensure that it doesn't pull through or break. In one example, the U-shaped channel 90 may be substantially 5 inches in height with two protruding legs about 2" long, but any dimension or size of the channel may be used, in correlation with the manufactured heights of the top and bottom flanges of the shell 20 and the cover 30.

Figure 14:
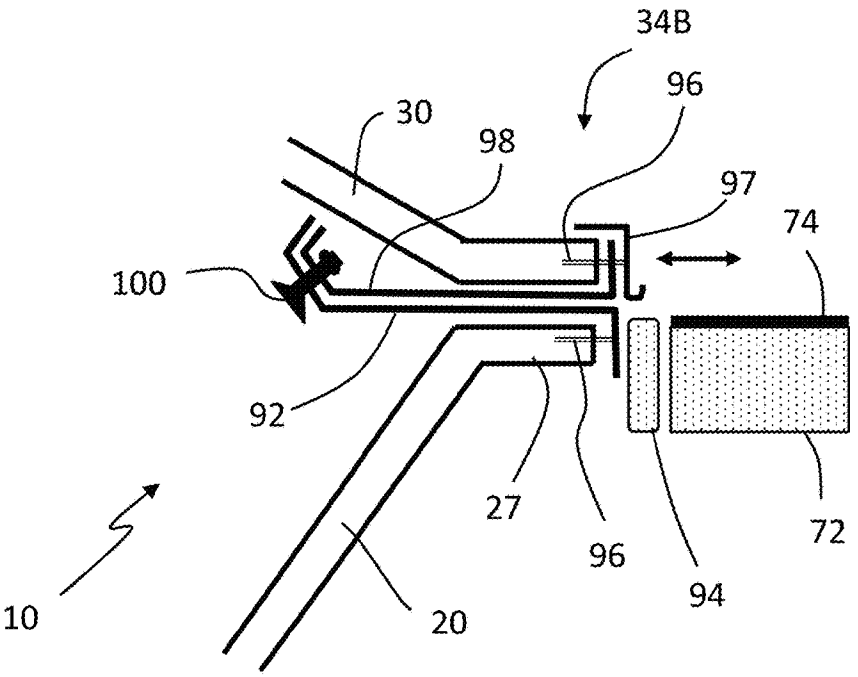
FIGS. 13-14 are detailed, diagrammatical illustrations of the interface between the cover and the shell along the front and rear of the shell, respectively, in accordance with the first exemplary embodiment of the present disclosure.
Figure 13:
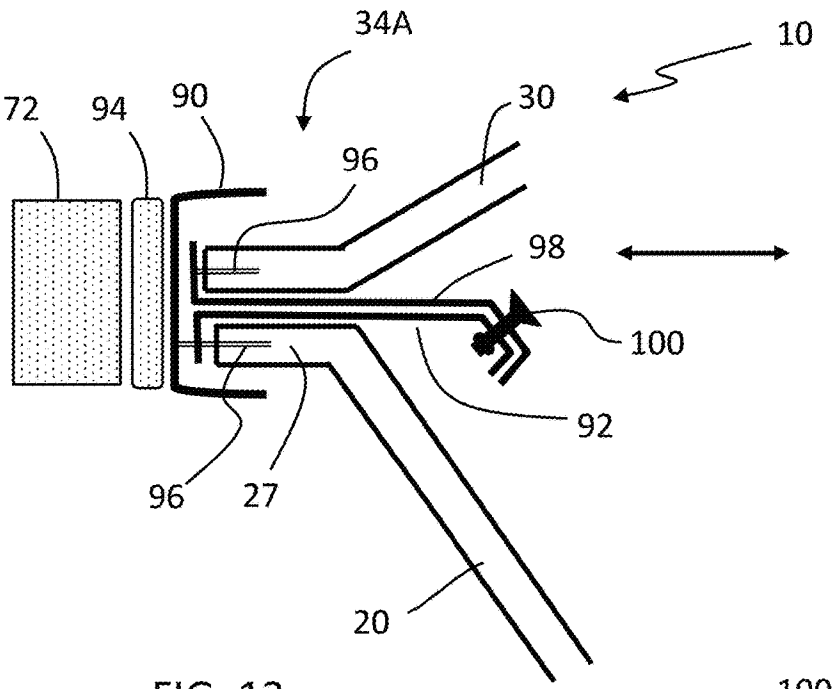

Along the front edge 26 of the shell 20, the U-shaped channel 90 may be positioned to receive the front terminating edge 34A of the cover 30. Here, recessed, or inset bolts may be used to connect the U-shaped channel 90 to the cover 30. Along the back edge of the shell 20, opposite the front edge 26, the top flange of the shell 20 may not be constrained within a U-shaped channel, thereby allowing the rear, terminating edge 34B of the cover 30 to move off the shell 20 and laterally outwards as the cover 30 is opened. FIGS. 13-14 are detailed, diagrammatical illustrations of the interface between the cover 30 and the shell 20 along the front and rear of the shell, respectively, in accordance with the first exemplary embodiment of the present disclosure.

In particular, FIG. 13 depicts the front edge 34A of the cover 30 and how it is received into the U-shaped channel 90 along the front edge of the shell 20. As can be seen, the U-shaped channel 90 is mounted to the lip or flange 27 of the shell 20, whereby a fastener 96 is connected through the U-shaped channel 90, through a piece of angled metal 92, such as an angled stainless steel with a thickness of $1/16^{th}$ inch and connected to the flange 27. An expansion joint foam 94 or similar material may be applied between the side of the flange 27 and an abutting concrete skirt 72 to prevent direct contact between the metal U-shaped channel 90 and the concrete. On the cover 30, at the front edge 34A thereof, a second angled metal 98 piece is connected to the cover with a fastener 96. This fastener 96 may be recessed into the second angled metal 98 piece to ensure there is adequate clearance with the internal surface of the U-shaped metal channel 90. The angled metal 98 piece may be used to increase the strength of the cover 30 along the front edge 34A, in particular, to ensure it does not sag or dip at the edges thereof especially when weight is applied, such as if it were used as a handrail by an occupant entering or exiting the shell 20. Sagging of the cover 30 can hinder or complicate opening and closing of the cover 30. Additionally, the second angled metal piece 98 may mate with the angled metal piece 92 of the shell 20, such that when the cover 30 is in the fully closed position, as shown in FIG. 13, the two angled metal pieces 92, 98 mate together. In this position, the front edge 34A of the cover 30 is positioned substantially within the U-shaped channel 90 and the angled metal pieces 92, 98 are positioned internal of the cover 30 and the shell 20, such that they can be accessed by an occupant. One or more removable locking fasteners 100 can be inserted through one or more holes formed within the lower angled metal 92 and the upper angled metal 98 to removably lock the cover 30 in the closed position.

Figure 15:
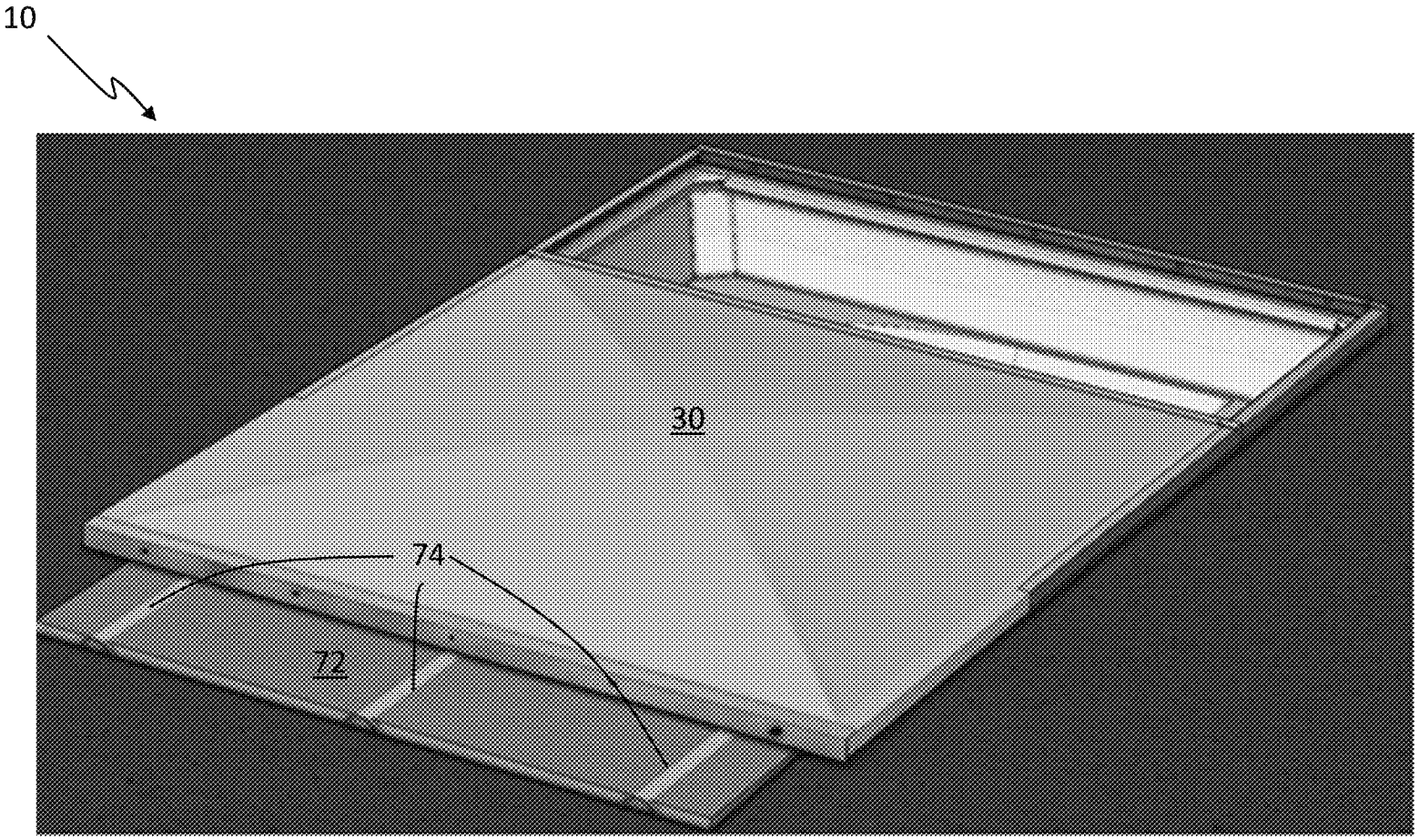
FIG. 15 illustrates the apparatus with the cover moved relative to the concrete and depicts the low-friction members partially embedded within the concrete, in accordance with the first exemplary embodiment of the present disclosure.

FIG. 14 depicts the opposite side of the cover 30, where the rear edge 34B of the cover 30 is positioned over the shell 20 and where it can be moved lateral from the shell 20 when the cover 30 is opened. As shown, the rear edge 34B of the cover 30 includes two angled metal pieces 97, 98 which are fastened to the cover 30 with a fastener 96, such as a threaded fastener or the like. Angled metal piece 98 may extend inwards of the cover 30 such that it can mate with an angled metal piece 92 positioned on the shell 20, whereas angled metal piece 97 may be positioned on an exterior of the cover 30 and have a ramped edge or turned-up edge to make contact with the concrete 72, or more preferably, with one or more low-friction members 74 positioned within the concrete. In one example the low-friction members 74 may be PVC pipe which is partially embedded within the concrete 72, such that a portion of the PVC pipe is exposed and can make contact with the second metal piece 99. This may ensure that there is less wear between the structures than if the metal piece 99 were to contact the concrete 72 directly. FIG. 15 illustrates the apparatus 10 with the cover 30 moved relative to the concrete 72 and depicts the low-friction members 74 partially embedded within the concrete 72. Along the shell 20 is angled metal piece 92 which is connected to the flange 27 of the shell 20 with an appropriate fastener 96 and extends inwards of the shell 20 and cover 30. The interior portions of angled metal pieces 92, 98 may be sized to mate together, whereby a removable locking fastener 100 is insertable through a hole within these structures. This acts as a lock for the cover 30 relative to the shell 20. Expansion joint foam 94 or similar material may be applied between the side of the flange 27 and an abutting concrete skirt 72 to prevent direct contact between angled metal piece 92 and the concrete 72.

Figure 16:
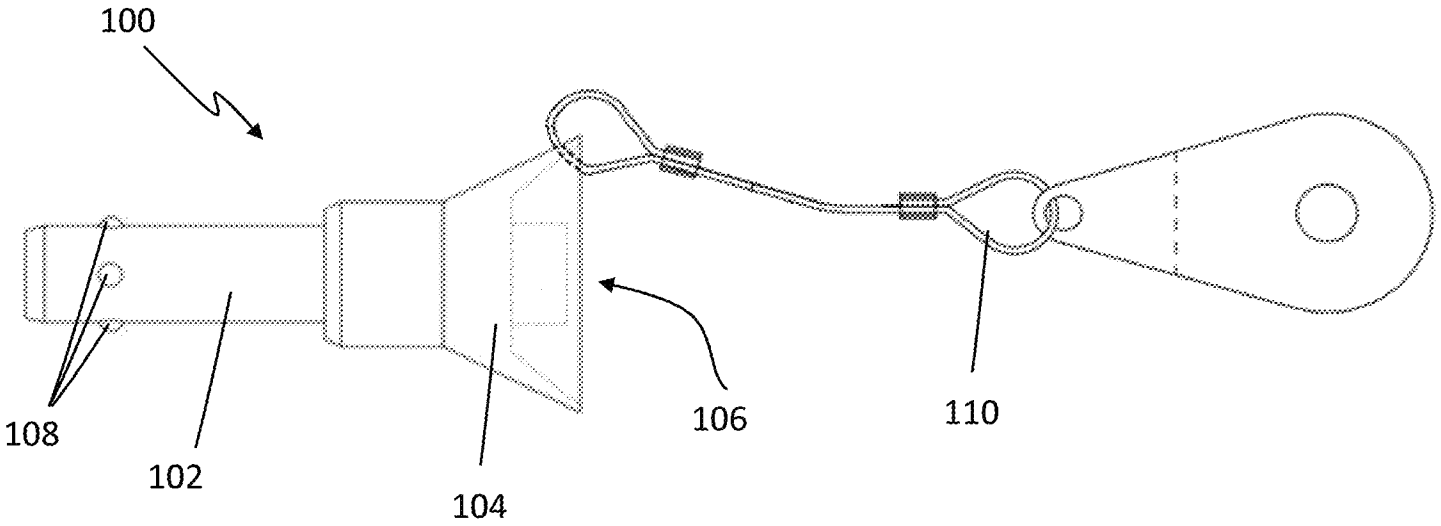
FIG. 16 illustrates an image of the removable locking fastener which can be used to retain the cover in a locked position over the shell, in accordance with the first exemplary embodiment of the present disclosure.

FIG. 16 illustrates an image of the removable locking fastener 100 which can be used to retain the cover 30 in a locked position over the shell 20. As shown, the removable locking fasteners 100 may include a shaft portion 102 which is elongated and sized to extend the length as noted relative to FIG. 13, i.e., through the angled metal pieces, 92, 98, through the U-shaped channel 90, and through the cover 30. The hole through which the shaft 102 is positionable may be sized just larger than the diameter of the shaft 102 itself. The removable locking fastener 100 may have a handle 104 within which is a depressible button 106 which controls lateral actuation of one or more protrusions 108 which are positioned on a distal end of the shaft 102. The user can depress the button 106 to retract the protrusions 108, insert the shaft 102 into the hole, and then release the button 106 which allows the protrusions 108 to extend outwards, thereby preventing the shaft 102 from being withdrawn. This type of fastener may be known as a 4 ball pin lock with recessed button, and any number of these removable locking fasteners 100 may be used with the cover. In a preferred embodiment, there are three removable locking fasteners 100 positioned along the front edge 34A of the cover 30 to lock it in a closed position, since three locking fasteners 100 will withstand the shear forces applied to the front edge 34A of the cover. To ensure that the removable locking fastener 100 is not lost or misplaced, it may be attached with a lanyard 110 to the shell 20, or to the cover 30, thereby ensuring it is always accessible.

Figure 17:
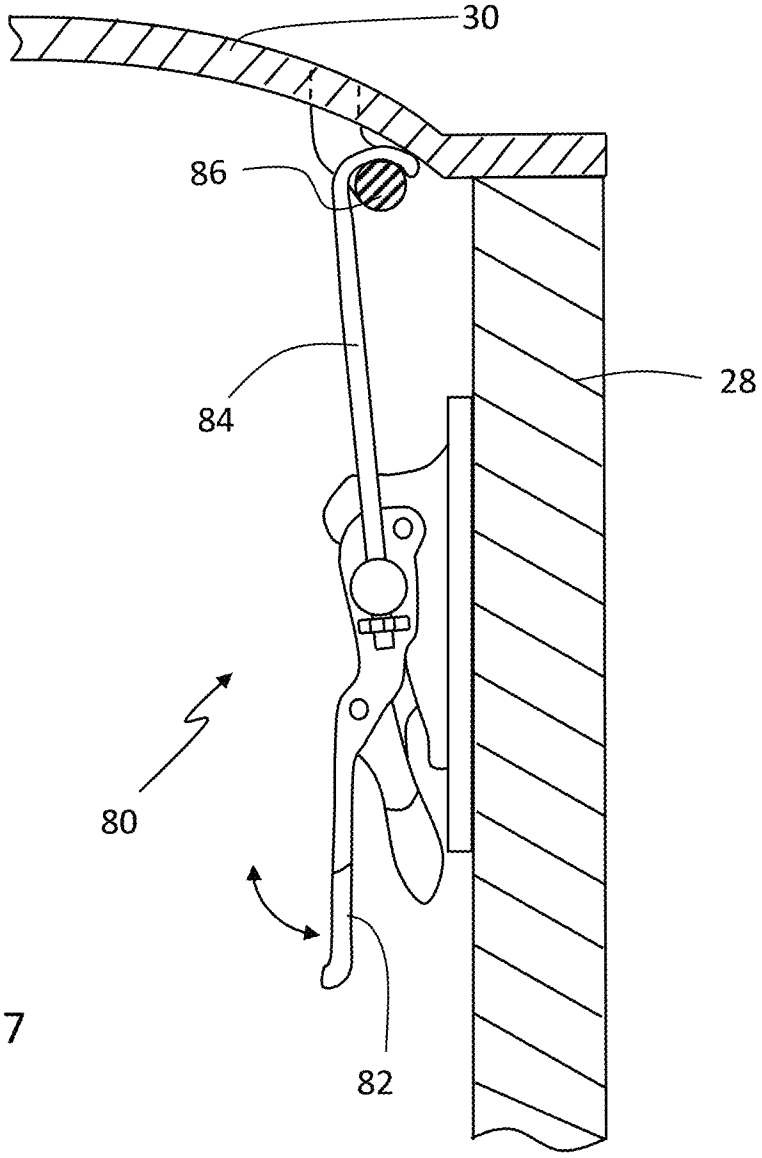
FIG. 17 is an image of a lock used with the tornado shelter apparatus, in accordance with another embodiment of the present disclosure.

There are various other ways that the cover 30 can be held in the locked position or locked to the shell 20. For instance, in a different example, FIG. 17 is an image of another lock which can be used with the tornado shelter apparatus 10, in accordance with another embodiment of the present disclosure. The locking device 80 is shown positioned on the sidewall 28 of the shell 20. When the cover 30 is slid to the closed position, it can be engaged with a locking receptacle positioned on the cover 30. In one example, the locking receptacle is a bar 86 molded into the flange of the cover 30 at the corner. It may be preferable to use four or more locking devices 80, e.g., one at each corner of the shell 20. Depending on the design, the locking device 80 may be accessible from inside the shell 20, exterior the shell 20, or both inside and exterior of the shell 20. FIG. 17 depicts one type of locking device 80 which may be used. This locking device 80 includes a handle 82 which is actuatable to move a clasp 84 to engage or disengage with a lock receptacle 86. This locking device 80 may include an upside down J-shaped clasp 84 that is able to hook over the lock receptacle 86. When engaged with the locking receptacle 86, the locking device 80 may be capable of pulling the cover 30 closed relative to the shell 20. It is noted that each of the locking devices 80 may be rated for 2000 pounds or more of hold down power which should be sufficient to retain the cover 30 in the closed position relative to the shell 20 when four or more locking devices 80 are used. Additionally, the locking devices 80 may be mounted on stainless steel plates positioned inside and outside of the shell 20 to disperse the loads of the through bolts required to hold the locking device 80 in place and provide additional spreading of the loads than the standard lock holes provided. While one type of locking device 80 is discussed herein, other types of designs of locking devices 80 may also be used, all of which are considered within the scope of the present disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A tornado shelter apparatus comprising:

a substantially unitary shell positionable at least partially below a ground surface;

a single cover slidably movable over an opening of the shell in a lateral direction, wherein the single cover is formed as a single, unitary structure without holes, gaps, or spaces therein, and has a shallow dome shape with a substantial center point of the single cover being positioned higher than all side edges of the single cover, wherein the shallow dome shape of the single cover provides a low angle of deflection for a tornado-driven object to deflect upwards and outwards from the single cover, and wherein the single cover covers an entirety of the opening when in a closed position;

a track connected to an upper rim of the opening, the track guiding sliding movement of the single cover, wherein when the single cover is in the closed position, all terminating portions of the side edges of the single cover are positioned over the upper rim of the opening; and at least one lock, removably locking the single cover to the shell.

2. The tornado shelter apparatus of claim 1, wherein the shell is formed from rotomolding.

3. The tornado shelter apparatus of claim 1, wherein a bottom of the shell further comprises a lip having an annular recess formed on an exterior of the shell.

4. The tornado shelter apparatus of claim 3, further comprising a quantity of concrete positioned at least partially within the annular recess.

5. The tornado shelter apparatus of claim 1, wherein the shell has a truncated cone shape having an angular sidewall, whereby a width dimension between opposing sidewalls at a top of the shell is greater than a width dimension between opposing sidewalls at a bottom of the shell.

6. The tornado shelter apparatus of claim 1, further comprising at least one airflow inlet pipe connected to the shell, wherein the at least one airflow inlet pipe slopes away from the shell.

7. The tornado shelter apparatus of claim 1, wherein the cover further comprises at least one angled metal support positioned along an edge thereof, and wherein the shell further comprises at least one angled metal member connected to a flange of the shell, wherein a removable locking fastener is insertable through the at least one angled metal member, the cover, and the angled metal support, thereby retaining the cover in a closed position.

8. The tornado shelter apparatus of claim 1, further comprising a quantity of concrete positioned substantially at the ground surface along a rear edge of the cover, whereby when the cover is moved to an opened position, at least a portion of the cover contacts at least one low-friction material within the quantity of concrete.

9. A system for providing a tornado shelter, the system comprising:

a substantially unitary shell formed from a plastic or fiberglass material, the substantially unitary shell positionable at least partially below a ground surface, whereby a flange of the shell is positioned substantially flush with the ground surface, wherein the shell has an interior compartment and an opening to the interior compartment;

a single cover slidably movable over the opening of the shell in a lateral direction, wherein the single cover is formed as a single, unitary structure without holes, gaps, or spaces therein, and has a shallow dome shape, whereby a substantial center point of the single cover is positioned higher than all side edges of the single cover, wherein the shallow dome shape of the single cover provides a low angle of deflection for a tornado-driven object to deflect upwards and outwards from the single cover, and wherein the single cover covers an entirety of the opening when in a closed position;

a track system positioned along at least a portion of the flange of the shell at an upper rim of the opening, the track system guiding lateral slidable movement of the single cover, wherein when the cover is in the closed position, all terminating portions of the side edges of the single cover are positioned over the upper rim of the opening; and at least one removable locking fastener capable of being used by an individual within the interior compartment to removably lock the single cover to the shell.

10. The system of claim 9, wherein a bottom of the shell further comprises a lip having an annular recess formed on an exterior of the shell.

11. The system of claim 10, further comprising a quantity of concrete positioned at least partially within the annular recess, wherein the quantity of concrete retains the shell within the ground surface during tornado conditions.

12. The system of claim 9, wherein the shell has a truncated cone shape having an angular sidewall, whereby a width dimension between opposing sidewalls at a top of the shell is greater than a width dimension between opposing sidewalls at a bottom of the shell.

13. The system of claim 9, wherein the cover further comprises at least one angled metal support positioned along an edge thereof, and wherein the shell further comprises at least one angled metal member connected to a flange of the shell, wherein the at least one removable locking fastener is insertable through the at least one angled metal member, the cover, and the angled metal support, thereby retaining the cover in a closed position.

* * * * *